US008360424B2

(12) United States Patent
Tomii et al.

(10) Patent No.: US 8,360,424 B2
(45) Date of Patent: Jan. 29, 2013

(54) SHEET THICKNESS DETECTION DEVICE AND IMAGE FORMING APPARATUS

(75) Inventors: Taishi Tomii, Toride (JP); Yoshitaka Yamazaki, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/034,087

(22) Filed: Feb. 24, 2011

(65) Prior Publication Data

US 2011/0210505 A1 Sep. 1, 2011

(30) Foreign Application Priority Data

Feb. 26, 2010 (JP) ..... 2010-042449

(51) Int. Cl.
*B65H 7/02* (2006.01)

(52) U.S. Cl. ..... 271/265.04

(58) Field of Classification Search ..... 271/262, 271/263, 265.04
See application file for complete search history.

(56) References Cited

U.S. PATENT DOCUMENTS

| | | | | |
|---|---|---|---|---|
| 5,437,445 | A * | 8/1995 | Chang et al. | 271/263 |
| 5,727,692 | A * | 3/1998 | Large et al. | 209/603 |
| 7,355,763 | B2 | 4/2008 | Furihata | |
| 2003/0160081 | A1 | 8/2003 | Lim et al. | |
| 2005/0184455 | A1 | 8/2005 | Youn | |
| 2008/0012216 | A1 | 1/2008 | Tsukamoto et al. | |
| 2008/0265499 | A1 | 10/2008 | Sugiyama | |
| 2011/0262152 | A1 | 10/2011 | Koizumi | |

FOREIGN PATENT DOCUMENTS

| | | | |
|---|---|---|---|
| JP | 04-182244 | A | 6/1992 |
| JP | 2872022 | B2 | 3/1999 |
| JP | 2004256293 | A * | 9/2004 |
| JP | 2008-254855 | A | 10/2008 |

OTHER PUBLICATIONS

Yoshitaka, Yamazaki. "Sheet Thickness Detection Device and Image Forming Apparatus," Specification and Drawings of unpublished related co-pending U.S. Appl. No. 13/034,102, filed Feb. 24, 2011 pp. 1-83.

* cited by examiner

*Primary Examiner* — Michael McCullough
(74) *Attorney, Agent, or Firm* — Rossi, Kimms & McDowell LLP

(57) ABSTRACT

An image forming apparatus capable of accurately detecting a thickness of various sheets. A CPU of the image forming apparatus sets the degree of amplification to a large value, if a sheet basis weight is equal to or less than a threshold value, and sets the degree of amplification to a small value, if the sheet basis weight is larger than the threshold value. One of magnetic sensors, which are disposed facing respective ones of magnets mounted to a displacement member of a sheet thickness detection device of the image forming apparatus, is selected according to the set degree of amplification. When a sheet passes through a detection part of the displacement member, a displacement of the detection part amplified through the displacement member is detected by the selected sensor and a sheet thickness is detected based on an output of the sensor.

14 Claims, 18 Drawing Sheets

SHEET THICKNESS DETECTION DEVICE AND IMAGE FORMING APPARATUS

BACKGROUND OF THE INVENTION

1. Field of the Invention

The present invention relates to a sheet thickness detection device for detecting a thickness of a sheet, and relates to an image forming apparatus mounted with the sheet thickness detection device.

2. Description of the Related Art

In recent years, an investigation has been made to develop a sheet thickness detection apparatus able to accurately measure thicknesses of sheets from thin sheets such as 52 gram paper to thick sheets such as 400 gram paper. The term "52 gram paper" refers to a sheet having a basis weight of 52 grams per square meter and the term "400 gram paper" refers to a sheet having a basis weight of 400 grams per square meter.

An image forming apparatus, such as a copying machine and a printer, is mounted with a sheet conveyance roller. When a sheet passes through the conveyance roller, a rotation shaft (roller shaft) of the conveyance roller is displaced by an amount corresponding to a sheet thickness. A sheet thickness detection device has been proposed that measures a sheet thickness by detecting a displacement of the roller shaft by using a magnetic sensor, which is disposed to face a magnet attached to one end of the roller shaft (see, Japanese Laid-open Patent Publication No. 2008-254855).

Another sheet thickness detection device is disclosed in Japanese Patent Publication No. 2872022. The disclosed device has a reference roller disposed alongside a conveyance path and a detection roller disposed to face the reference roller. The detection roller is configured to be displaced to follow the thickness of a sheet passing through between the reference roller and the detection roller. The sheet thickness is detected through gears that are driven to follow the displacement of the detection roller. Further, the amount of displacement of the detection roller caused by passage of a sheet between the rollers is amplified to improve the accuracy of sheet thickness detection and to enable detection of the number of sheets being fed in multiple, if multiple feeding occurs.

However, when an attempt is made to detect the thickness of an ultra-thin sheet such as 38 gram paper by using the sheet thickness detection device disclosed in Japanese Laid-open Patent Publication No. 2008-254855, the resultant output of the magnetic sensor representing the sheet thickness becomes small.

Assuming that voltage levels of sensor output in a non sheet passage state and in a sheet passage state are respectively represented by $v_0$ and $v_1$, a difference value $|v_1-v_0|$ represents a sensor output corresponding to sheet thickness. If the sensor output $|v_1-v_0|$ is small, it is difficult to accurately detect the sheet thickness.

The sheet thickness detection device disclosed in Japanese Patent Publication No. 2872022 amplifies the amount of displacement of the detection roller caused by sheet passage at the same degree of amplification for sheets from thin sheets to thick sheets. If the linearity of sensor output characteristic is deteriorated (saturated) with increasing sheet thickness, the sensor output corresponding to sheet thickness cannot be obtained for thick sheets by the sheet thickness detection performed at the same degree of amplification irrespective of sheet thickness, so that the sheet thickness cannot accurately be detected.

SUMMARY OF THE INVENTION

The present invention provides a sheet thickness detection device capable of accurately detecting a thickness of various sheets, and provides an image forming apparatus mounted with the sheet thickness detection device.

According to a first aspect of this invention, there is provided a sheet thickness detection device for detecting a thickness of a sheet being conveyed, which comprises a conveyance unit configured to convey a sheet along a conveyance path, a displacement member configured to be displaced to follow a thickness of the sheet being conveyed, a displacement amount detection unit configured to detect an amount of displacement of the displacement member at plural positions with different degrees of amplification by which the amount of displacement is amplified, and a sheet thickness detection unit configured to detect the thickness of the sheet based on a result of detection by the displacement amount detection unit in at least one of the plural positions.

With the sheet thickness detection device described in the first aspect, a sheet thickness can accurately be detected based on a result of detection of an amount of displacement of the displacement member by the displacement amount detection unit in at least one of the plural positions with different degrees of amplification by which the amount of displacement is amplified. Specifically, the amount of displacement of the displacement member is detected at a low amplification degree for a thick sheet, whereas the amount of displacement is detected at a high amplification degree for a thin sheet, whereby an output characteristic region of the displacement amount detection unit where an excellent linearity is obtainable can selectively be utilized, so that a thickness of various sheets from ultra-thin sheets such as 38 gram paper to thick sheets can be detected with accuracy.

According to a second aspect of this invention, there is provided a sheet thickness detection device for detecting a thickness of a sheet being conveyed, which comprises a conveyance unit configured to convey a sheet along a conveyance path, a displacement member configured to be displaced to follow a thickness of the sheet being conveyed, a displacement amount detection unit configured to detect an amount of displacement of the displacement member with a plurality of different sensitivities, a sensitivity changeover unit configured to change a sensitivity of the displacement amount detection unit, and a sheet thickness detection unit configured to detect the thickness of the sheet based on a result of detection by the displacement amount detection unit with the sensitivity changed by the sensitivity changeover unit.

With the sheet thickness detection device described in the second aspect, the sensitivity of the displacement amount detection unit is changed according to a sheet thickness. Specifically, the sensitivity is raised for a thin sheet since the displacement member is displaced by a small amount upon passage of the thin sheet through the driven displacement member, whereas the sensitivity is lowered for a sheet other than a thin sheet, whereby a thickness of various sheets from thin sheets to thick sheets can accurately be detected.

According to a third aspect of this invention, there is provided a sheet thickness detection device for detecting a thickness of a sheet being conveyed, which comprises a conveyance unit configured to convey a sheet along a conveyance path, a displacement member configured to be displaced to follow a thickness of the sheet being conveyed, a displacement amount detection unit configured to detect an amount of displacement of the displacement member at plural positions with different degrees of amplification by which the amount of displacement is amplified, a sensitivity changeover unit configured to change a sensitivity of the displacement amount detection unit, and a sheet thickness detection unit configured to detect the thickness of the sheet based on a result of detection by the displacement amount detection unit in the at least one of the plural positions with the sensitivity changed by the sensitivity changeover unit.

With the sheet thickness detection device described in the third aspect, if it is difficult to detect the sheet thickness by only changing the amplification degree or by only changing the magnetic sensor sensitivity, the amplification degree and the sensor sensitivity are changed in an optimum combination to accurately detect the sheet thickness. Specifically, it is possible to accurately detect the sheet thickness by increasing the amplification degree and the magnetic sensor sensitivity for ultra-thin sheets, but by decreasing the amplification degree and the magnetic sensor sensitivity for extremely thick sheets.

In this invention, the displacement member can be comprised of a swing member pivotable about a fixed shaft, and one end portion of the swing member can be pivoted to follow the thickness of the sheet and an amount of pivot of another end portion of the swing member can be detected, as an amplified amount of displacement, by the displacement amount detection unit. In this case, the amount of pivot of another end portion of the swing member is detected as the amount of displacement, and therefore the sheet thickness can be detected with ease.

The displacement amount detection unit can include a plurality of magnetic bodies mounted to the swing member at different positions and a plurality of magnetic sensors disposed facing respective ones of the magnetic bodies, and a magnetic flux density generated by any of the magnetic bodies can be detected by a corresponding one of the magnetic sensors, whereby the amount of pivot of the other end portion of the swing member can be detected as the amplified amount of displacement. In this case, the amplification degree by which the amount of displacement of the displacement member is amplified can variably be changed with ease by changing mounting positions of the magnets and installation positions of the magnetic sensors.

The sheet thickness detection devices described in the second and third aspects can each include an electric current supply unit configured to supply an electric current to the displacement amount detection unit, and the sensitivity changeover unit can change the sensitivity of the displacement amount detection unit by changing a value of the electric current supplied from the electric current supply unit to the displacement amount detection unit. In this case, the sensitivity of the displacement amount detection unit can easily be changed by changing the value of the electric current supplied to the displacement amount detection unit.

According to a fourth to sixth aspects of this invention, there are provided image forming apparatuses each mounted with a corresponding one of the sheet thickness detection devices described in the first to third aspects. With the image forming apparatuses described in the fourth to sixth aspects, it is possible to improve the quality of sheet product output from these image forming apparatuses and to appropriately control image process.

Further features of the present invention will become apparent from the following description of exemplary embodiments with reference to the attached drawings.

DESCRIPTION OF THE EMBODIMENTS

The present invention will now be described in detail below with reference to the drawings showing preferred embodiments thereof.

First Embodiment

Figure 1:
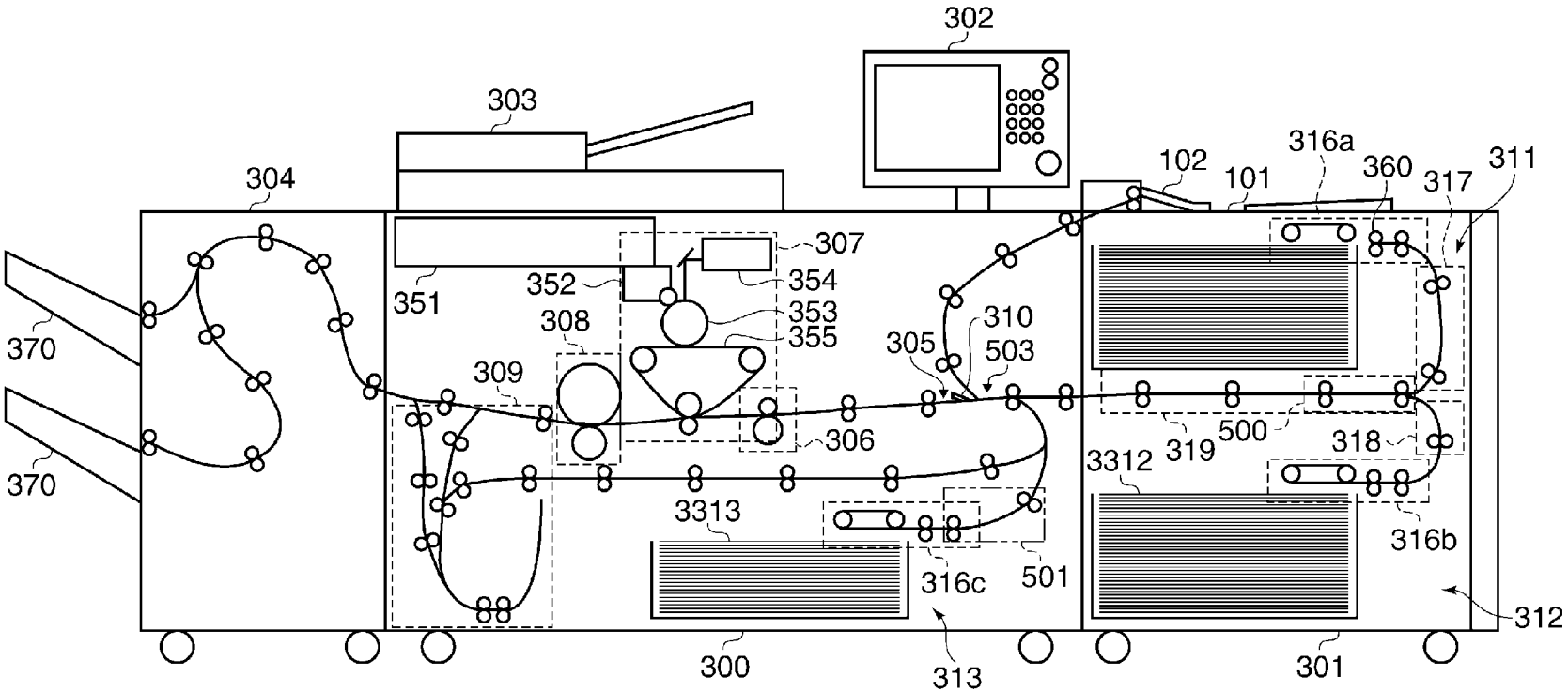
FIG. 1 is a schematic view showing the construction of an image forming system mounted with sheet thickness detection devices according to a first embodiment of this invention.

FIG. 1 shows the construction of an image forming system mounted with sheet thickness detection devices according to a first embodiment of this invention. The image forming system includes an image forming apparatus 300, sheet feeding apparatus 301, operation unit 302, reader scanner 303, and post-processing apparatus 304.

The image forming system performs sheet feeding, image formation, and post-processing based on sheet process settings set by a user through the operation unit 302 or through an external host PC (not shown) and image information transmitted from the reader scanner 303 or from the external host PC.

The sheet feeding apparatus 301 includes two sheet feed units 311, 312 respectively mounted with storage containers 3311, 3312 in which sheets are stored and from which sheets are fed, as required.

On a top surface of the sheet feeding apparatus 301, there are provided an escape sheet discharging tray 101 to which abnormal sheets caused by multiple feeding, sheet jam, or the like are forcibly discharged, and a sheet-full detection device 102 for detecting the sheet discharging tray 101 becoming full of sheets. Conveyance sensors (not shown) for detecting sheet passage are provided in conveyance paths.

For sheet feeding, upper and lower sheet feeding conveyance units 316*a*, 316*b* are provided in the upper and lower sheet feed units 311, 312. Further, a sheet feeding conveyance unit 316*c* is provided in a sheet feed unit 313 of the image forming apparatus 300.

In this embodiment, the sheet feeding conveyance units 316*a*, 316*b* and 316*c* each include a fan (not shown) for control of air sheet feed. During the sheet feeding, the fan is driven to feed air into between sheets in the storage container 3311, 3312 or 3313 from the upstream side in the sheet conveyance direction. Sheets in the storage container are separated from one another and then fed and conveyed one by one, while an uppermost sheet being sucked to an endless belt of the unit 316*a*, 316*b* or 316*c* by a sheet suction fan provided in the endless belt.

In the upper sheet feed unit 311, a sheet conveyed by the endless belt of the sheet feeding conveyance unit 316*a* is further conveyed by an upper conveyance unit 317 toward a confluent conveyance unit 319 with which the upper conveyance unit 317 merges. In the lower sheet feed unit 312, a sheet conveyed by the endless belt of the sheet feeding conveyance unit 316*b* is further conveyed by a lower conveyance unit 318 toward the confluent conveyance unit 319 with which the lower conveyance unit 318 merges.

The confluent conveyance unit 319 is provided with a sheet thickness detection device 500 for sequentially detecting thicknesses of sheets, which are fed and conveyed from the sheet feed unit 311 or 312.

Figure 2:
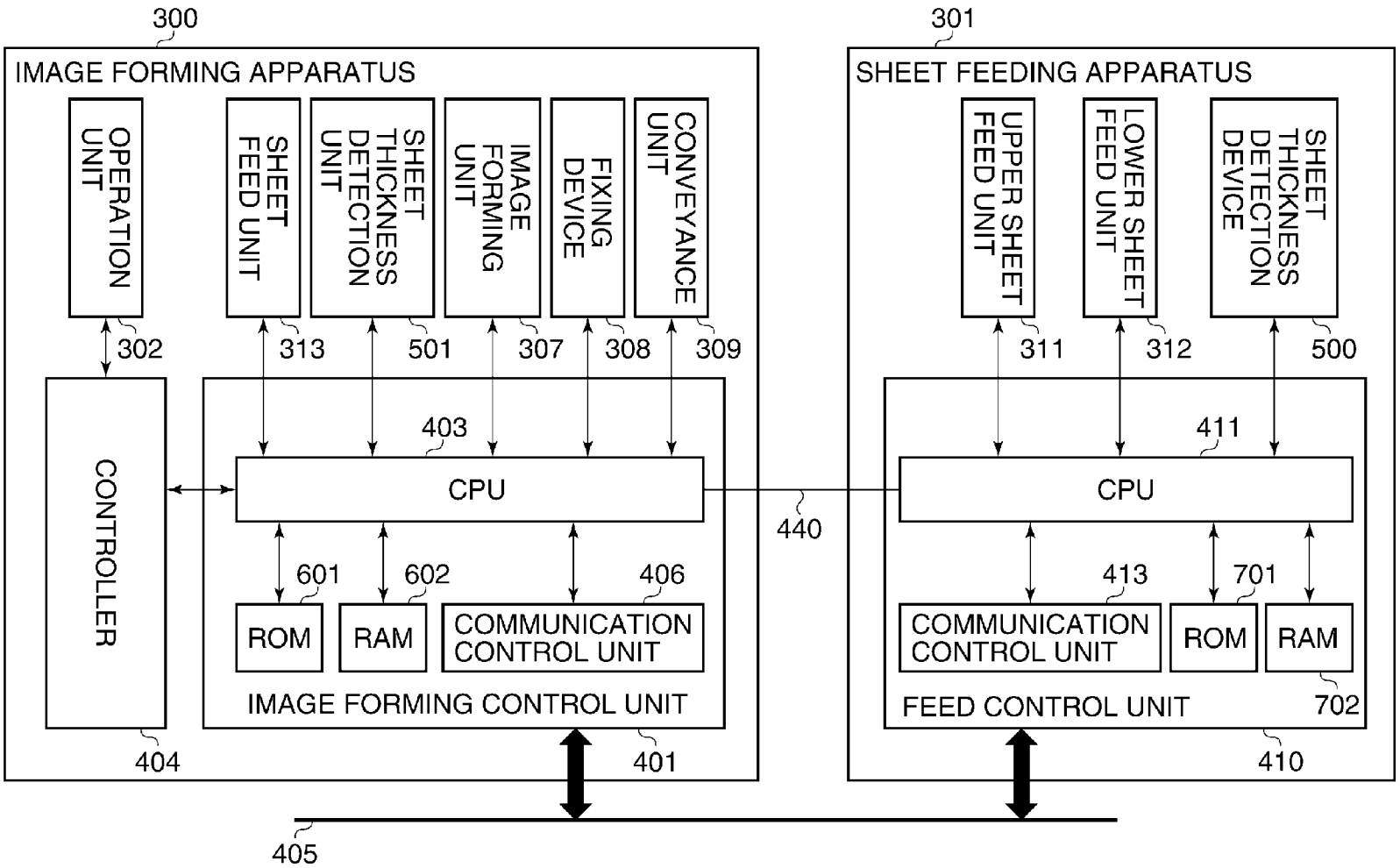
FIG. 2 is a block diagram showing the construction of a sheet conveyance control system of the image forming system.

The conveyance units 317 to 319 each include a stepping motor controlled by a conveyance control system shown in FIG. 2 and conveyance rollers 360 rotated for sheet conveyance by the stepping motor.

In response to a sheet supply request from the image forming apparatus 300, the sheet feeding apparatus 301 sequentially feeds and conveys sheets from the storage container 3311 or 3312, and notifies the image forming apparatus of completion of preparation each time a sheet reaches a pre-registration position.

Upon receipt of the preparation completion notification from the sheet feeding apparatus 301, the image forming apparatus 300 notifies a delivery request. The sheet feeding apparatus 301 supplies the sheet from the pre-registration position to the image forming apparatus 300 each time the delivery request is notified. The image forming apparatus 300 receives sheets one by one and forms an image on the received sheet. The sheet feeding apparatus 301 stops operation and enters a standby state after supplying the requested number of sheets.

On the top of the image forming apparatus 300, there are disposed the operation unit 302 through which the user performs operation settings of the image forming system, and the reader scanner (reader unit) 303 for reading an image of an original.

The image forming apparatus 300 receives a sheet from the sheet feed unit 311 or 312 of the sheet feeding apparatus 301 or from the sheet feed unit 313 of the image forming apparatus 300, and controls the conveyance unit to convey the sheet. Since the sheet feed unit 313 is the same in construction as the sheet feed units 311, 312, a description thereof is omitted.

In the image forming apparatus 300, a sheet thickness detection device 501 for sequentially detecting thicknesses of sheets fed and conveyed from the sheet feed unit 313 is disposed along a conveyance path extending from the sheet feed unit 313 to an image forming unit 307. The sheet thickness detection device 501 has the same construction as that of the sheet thickness detection device 500 of the sheet feeding apparatus 301.

According to a result of sheet thickness detection by the sheet thickness detection device 500 or 501, operation of a flapper 310 of the image forming apparatus 300 is controlled. If the detected sheet thickness is abnormal, the flapper 310 is controlled to select a conveyance path to the escape sheet discharging tray 101, whereby the corresponding sheet is discharged to the tray 101.

If the detected sheet thickness is normal, the flapper 310 is controlled to select a conveyance path to the image forming unit 307, whereby the corresponding sheet is conveyed to the image forming unit 307. The image forming unit 307 performs image formation based on received image data triggered by sheet detection by a sensor 305.

The image forming unit 307 includes a developing unit 352, photosensitive drum 353, laser scanner unit 354, and intermediate transfer belt 355. The image forming unit 307 performs light amount control such as lighting a semiconductor laser in the laser scanner unit 354 and controls a scanner motor to rotatably drive a polygon mirror (not shown), whereby laser light is irradiated onto the photosensitive drum 353 according to image data and a latent image is formed on the photosensitive drum 353.

In the image forming unit 307, the latent image on the photosensitive drum 353 is developed into a toner image by a developing unit 352 to which toner is supplied from a toner bottle 351. The toner image on the photosensitive drum 353 is transferred to an intermediate transfer belt 355 and further transferred from the transfer belt 355 to a sheet.

A registration control unit 306 disposed short of a secondary-transfer position performs, without stopping sheet conveyance, an inclination correction to the sheet located at a position immediately short of the secondary-transfer position and performs sheet conveyance control to finely adjust and match a position of the leading end of the sheet to the toner image formed on the intermediate transfer belt 355.

The sheet onto which the toner image has been transferred is conveyed to a fixing device 308 that applies heat and pressure to the sheet to fuse the toner, thereby fixing the toner image onto the sheet. At that time, a controlled temperature of the fixing device 308 is determined according to the result of detection by the sheet thickness detection device 500 or 501. Specifically, the controlled temperature of the fixing device 308 is set to be lower than a normal temperature if the sheet thickness is thin and set to be higher than the normal temperature if the sheet thickness is thick, whereby a fixing failure which would be caused by heat loss due to heat capacity of the sheet can be prevented and an image failure due to, e.g., gross reduction in the fixed image which would be caused by excessive heat being applied to the toner can be prevented.

If printing should be made on a rear surface of the sheet or if the sheet should be reversed from front to back, the sheet onto which the toner image has been fixed is conveyed to an inversion conveyance unit 309. On the other hand, if printing should be completed, the sheet is conveyed to the post-processing apparatus 304.

The post-processing apparatus 304 is disposed downstream of the image forming apparatus 300 and performs the desired post-processing (such as folding, stapling, or punching) set by the user through the operation unit 302 on sheets on which images have been formed. A resultant product (i.e., sheets for which the post-processing has been made) is discharged to one of sheet discharge trays 370 and provided to the user.

FIG. 2 shows in block diagram the construction of a sheet conveyance control system of the image forming system. A job request is made by the user to the image forming apparatus 300 from the operation unit 302 or from an external PC via a network (not shown), USB, or the like.

At the time of copying, image information is sent from the reader unit 303 to a controller 404 of the image forming apparatus 300. At the time of printing, image information is sent from the network to the controller 404.

The image information sent to the controller 404 is subjected to image processing specified by the user or image processing to convert the image information into an image form suited to the image forming apparatus 300.

Along with image data on which image processing has been made, various pieces of status information (such as image size information, page information, information representing a sheet feed unit to be used, sheet discharge information) are transmitted from the controller 404 to an image forming control unit 401 of the image forming apparatus 300.

The sheet feed unit information corresponds to sheets designated (as being used in the job) by the user via the operation unit 302, network, USB, or the like.

As a preparatory process for the sheet designation, information representing sheets stored in the sheet feed units 317 to 319 is specified in advance by the user before execution of the job. The sheet information represents sizes, basis weights, and surface properties of sheets stored in the sheet feed unit 317 to 319, and is notified via the controller 404 to and stored into the image forming control unit 401 of the image forming apparatus 300 and a feed control unit 410 of the sheet feeding apparatus 301.

The image forming apparatus 300, sheet feeding apparatus 301, and post-processing apparatus 304 are connected to one another via a bus 405, which is implemented by a serial bus capable of providing multiple connection, such as I2C or ARCNET (registered trademark).

A signal line for a delivery timing signal 440 is connected between the image forming apparatus 300 and the sheet feeding apparatus 301. The delivery timing signal 440 provides a trigger for sheet delivery and conveyance from the sheet feeding apparatus 301 to the image forming apparatus 300.

The sheet delivery and conveyance is controlled by the feed control unit 410 of the sheet feeding apparatus 301. The speed of delivery and conveyance triggered by the delivery timing signal 440 is the same as the conveyance speed in the image forming apparatus 300, which is set to a maximum speed at or below which the desired quality of image formation such as fixing property and transfer property can be satisfied. Since the sheet feeding apparatus 301 is less subjected to such restriction, sheets can be conveyed at a higher speed in the sheet feeding apparatus 301 than in the image forming apparatus 300.

Since a control unit of the post-processing apparatus 304 is unnecessary to be described in detail in relation to this invention, a description thereof is omitted.

The image forming control unit 401 is provided with a CPU 403. The CPU 403, which is connected by communication to the controller 404, exchanges status information with the controller 404, controls exchange of image data with the controller 404, and controls the timing of the image data exchange.

The CPU 403 is connected via a communication control unit 406 to the bus 405 and acquire status information from the sheet feeding apparatus 301. The CPU 403 detects states of respective units of the image forming apparatus 300 (such as the image forming unit 307, fixing device 308, and inversion conveyance unit 309), and delivers control commands to the units to control image formation and sheet conveyance for the image formation.

The sheet thickness detection device 501 is connected with the CPU 403 and outputs to the CPU 403 an output value representing a sheet thickness. The CPU 403 is able to adjust the output of the detection device 501.

A ROM 601 connected with the CPU 403 stores a control program for the CPU 403 and also stores initial setting values and control values for the image forming apparatus 300. In the ROM 601, characteristic tables such as data representing a relation between basis weight and sheet thickness (see, FIG. 6) and data representing a relation between output of the sheet thickness detection device 501 and sheet thickness (see, FIG. 5) are stored in advance.

A RAM 602, which is also connected with the CPU 403, is used to store, e.g., adjustment values for the sheet thickness detection device 501. The RAM 602 is implemented by a non-volatile memory battery-backed up when power supply to the image forming system is turned off.

The sheet feeding apparatus 301 is provided with a feed control unit 410 for feed control.

The feed control unit 410 includes a CPU 411 that inputs the delivery timing signal 440 from the image forming apparatus 300 and is triggered by the signal 440 to control the sheet delivery and conveyance from the sheet feeding apparatus 301 to the image forming apparatus 300. The CPU 411 controls the sheet conveyance in the sheet feeding apparatus 301 and exchanges, via a communication control unit 413, status information with, e.g., the image forming apparatus 300 connected to the bus 405.

The sheet feeding apparatus 301 includes the sheet feed units 311, 312. As previously described, the sheet feed units 311, 312 include the conveyance units 317, 318 and the confluent conveyance unit 319.

The sheet thickness detection device 500 is connected to the CPU 411 and outputs to the CPU 411 an output value representing a sheet thickness. The CPU 411 is able to adjust the output of the sheet thickness detection device 500, where required.

A ROM 701 connected to the CPU 411 stores a control program for the CPU 411, stores initial setting values and control values for the sheet feed units 311, 312, and stores characteristic tables (see FIGS. 5 and 6) for the sheet thickness detection device 500.

RAM 702, which is also connected with the CPU 411, is used to store, e.g., adjustment values for the sheet thickness detection device 500. The RAM 702 is implemented by a non-volatile memory battery-backed up when power supply to the image forming system is turned off.

Figure 3:
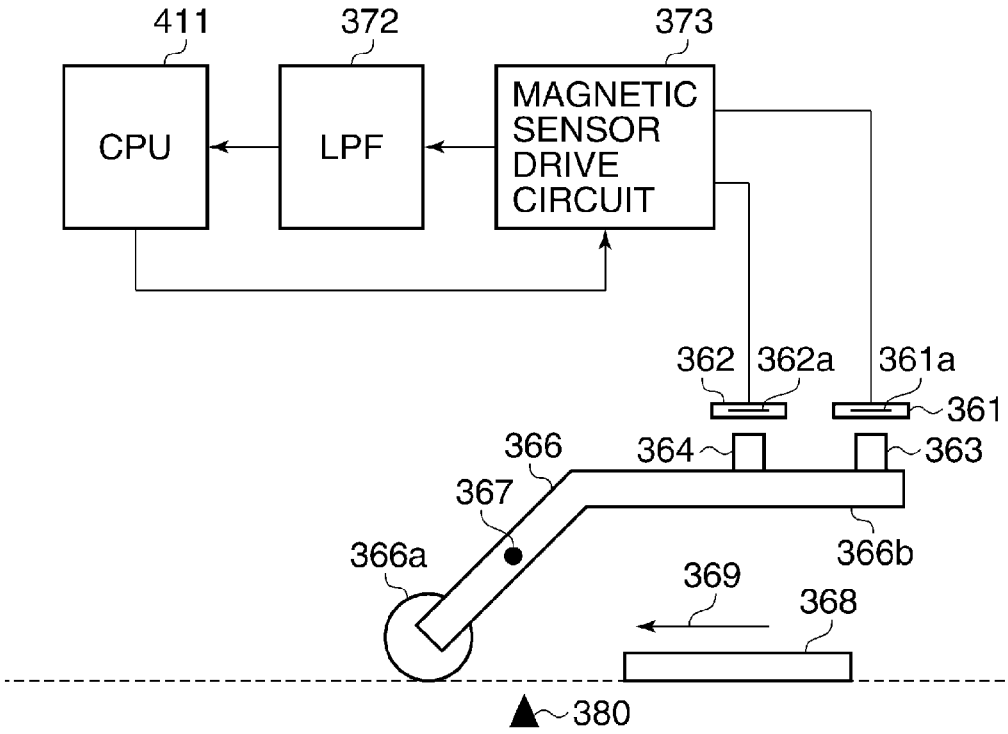
FIG. 3 is a schematic view showing the construction of one of the sheet thickness detection devices.

FIG. 3 shows the construction of the sheet thickness detection device 500 of the sheet feeding apparatus 301. Since the sheet thickness detection device 501 of the image forming apparatus 300 is the same in construction as the sheet thickness detection device 500, a description thereof will be omitted.

A sheet thickness is detected after lapse of a predetermined time period from when a sheet 368 entering the sheet thickness detection device 500 was detected by a conveyance path sensor 380. The sheet thickness detection device 500 mainly includes sheet thickness detection sensor boards 361, 362, magnets 363, 364 (magnetic bodies), and a driven displacement member (hereinafter, referred to as the driven member) 366. On the sheet thickness detection sensor boards 361, 362, there are disposed magnetic sensors 361*a*, 362*a* so as to face respective ones of the magnets 363, 364. The sheet thickness detection device 500 is also provided with a band restriction filter (LPF) 372 for removing, e.g., noise contained in the outputs of the magnetic sensors 361*a*, 362*a*. A signal from which noise is removed is input to the CPU 411 that performs arithmetic processing to decide a sheet thickness. The CPU 411 controls values of electric currents flowing through the magnetic sensors 361*a*, 362*a* and values of voltages applied to these magnetic sensors by using a magnetic sensor drive circuit 373.

Figure 4:
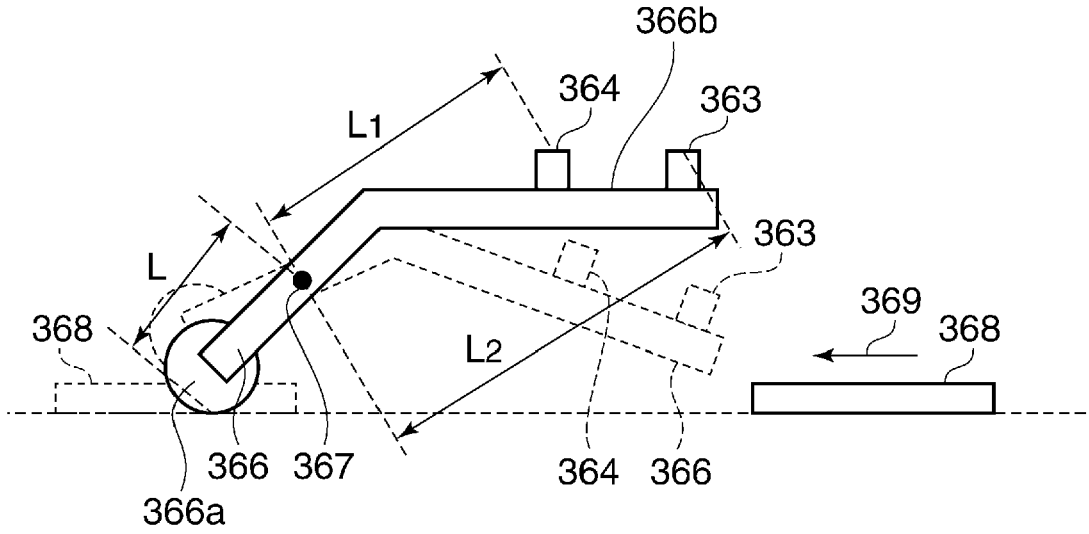
FIG. 4 is a view showing how the sheet thickness detection device operates.

FIG. 4 shows how the sheet thickness detection device 500 operates. The sheet 368 is conveyed in a direction shown by arrow 369 in FIG. 4, and reaches a tip end (roller) 366*a* or one end portion of the driven member 366. When the sheet 368 is further conveyed, the driven member 366 is displaced about a fulcrum (fixed shaft) 367 to follow the sheet thickness by an amount corresponding to the sheet thickness to assume a position indicated by a dotted line in FIG. 4. In other words, the driven member 366 is a swing member which is pivotable about the fulcrum (shaft) 367.

The magnets 363, 364 are attached to a rear end portion or another end portion 366*b* of the driven member 366. When the driven member 366 is displaced about the fulcrum 367, the magnets 363, 364 are displaced about the fulcrum 367, resulting in changes in magnetic flux densities around the magnetic sensors 361*a*, 362*a*. Each of the magnetic sensor 361*a*, 362*a* detects the change in magnetic flux density in the form of a voltage signal, which is transmitted to the CPU 411. The CPU 411 performs predetermined processing on the input voltage signal, whereby a sheet thickness is measured.

Next, a description will be given of the driven member 366 of the sheet thickness detection device 500, especially, a displacement amplification function thereof. As previously described, the magnets 363, 364 are attached to the rear end portion 366*b* of the driven member 366. It is assumed here that the magnets 363, 364 attached to positions on the driven member 366 where the following formula (1) is satisfied.

$$L_2/L > L_1/L > 1 \quad (1)$$

In formula (1), symbol $L_2$ denotes a distance between the fulcrum 367 of the driven member 366 and the center of the magnet 363, $L_1$ denotes a distance between the fulcrum 367 of the driven member 366 and the center of the magnet 364, and L denotes a distance between the fulcrum 367 and a portion of the roller 366*a* of the driven member 366 where the roller 366*a* is in contact with the sheet 368.

When the sheet 368 conveyed from the right side of FIG. 4 reaches the roller 366*a* and is further conveyed, the roller 366*a* is displaced as shown in FIG. 4, and the driven member 366 is pivoted about the fulcrum 367 in the clockwise direction in FIG. 4. Amounts of displacement of the magnets 363, 364 are respectively represented by x·L2/L and x·L1/L, where symbol x represents an amount of displacement of the roller 366*a*. Since the distances $L_2$, $L_1$ are set to be longer than the distance L as shown in formula (1), the amount of displacement of the roller 366*a* caused by sheet passage is amplified through the driven member 366.

In a case, for example, that the magnets 363, 364 are mounted to the driven member 366 in such a manner that relations of $L_2/L=3$ and $L_1/L=2$ are satisfied, the magnets 363, 364 are displaced about the fulcrum 367 by displacement amounts of 300 μm and 200 μm, respectively, when a sheet which is 100 μm in thickness passes through under the roller 366*a*. In other words, the amount of displacement of the roller 366*a* caused by sheet passage is amplified to be tripled and doubled, respectively, at the mounting positions of the magnets 363, 364.

Figure 5:
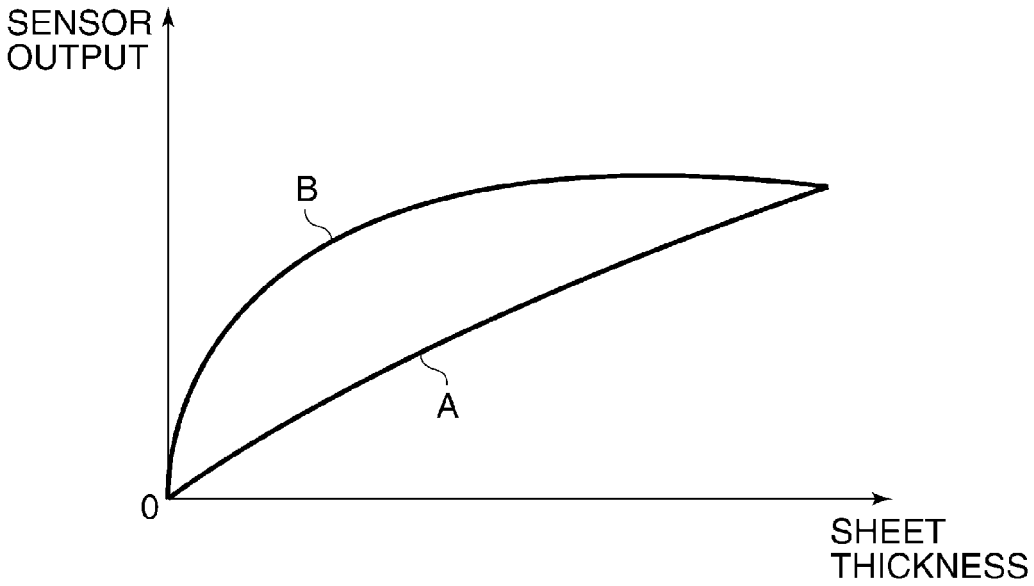
FIG. 5 is a graph showing sheet thickness-to-output characteristics of magnetic sensors of the sheet thickness detection device.

FIG. 5 is a graph of data showing a relation between sheet thickness and outputs (i.e., output characteristics) of the magnetic sensors 361, 362 of the sheet thickness detection device 500. Each output characteristic shown in FIG. 5 was obtained by, for example, measuring a difference value between levels of output voltage of the corresponding magnetic sensor at sheet feed and at non sheet feed for each of sheets having different thicknesses, while conveying the sheets in sequence to the sheet thickness detection device 500.

In FIG. 5, a symbol A denotes the output characteristic of the magnetic sensor 362*a* which is disposed to face the magnet 364 disposed near the fulcrum 367 of the driven member 366 and which is configured to detect, with a low amplification degree, a change in magnetic flux density around the magnet 364. On the other hand, a symbol B denotes the output characteristic of the magnetic sensor 361*a* which is disposed to face the magnet 363 disposed apart from the fulcrum 367 and which is configured to detect, with a high amplification degree, a change in magnetic flux density around the magnet 363.

The distance between each magnetic sensor and the corresponding magnet varies according to sheet thickness. Upon passage of a sheet which is thick in thickness, a gap distance between the magnetic sensor and the magnet becomes large and the magnetic flux generated by the magnet expands around the magnetic. As a result, the magnetic flux density that can be detected by the magnetic sensor decreases with the increasing gap distance. In other words, the sensor output is much saturated with the increasing sheet thickness, so that a sensor output corresponding to sheet thickness cannot be obtained with high resolution. According to, e.g., the sensor output characteristic shown by symbol B, the sensor output varies in proportion to sheet thickness for sheets each having a relatively thin thickness, but the sensor output is much saturated and becomes more out of proportion to sheet thickness with the increasing sheet thickness.

To obviate this, the sheet thickness detection devices 500, 501 of this embodiment are each configured to select either one of a plurality of (e.g., two) magnetic sensors to obtain an optimum output characteristic according to sheet thickness, thereby changing the degree of amplification in the detection of amount of displacement of the driven member 366 corresponding to sheet thickness. A description as to how the degree of amplification is changed will be given later.

Figure 6:
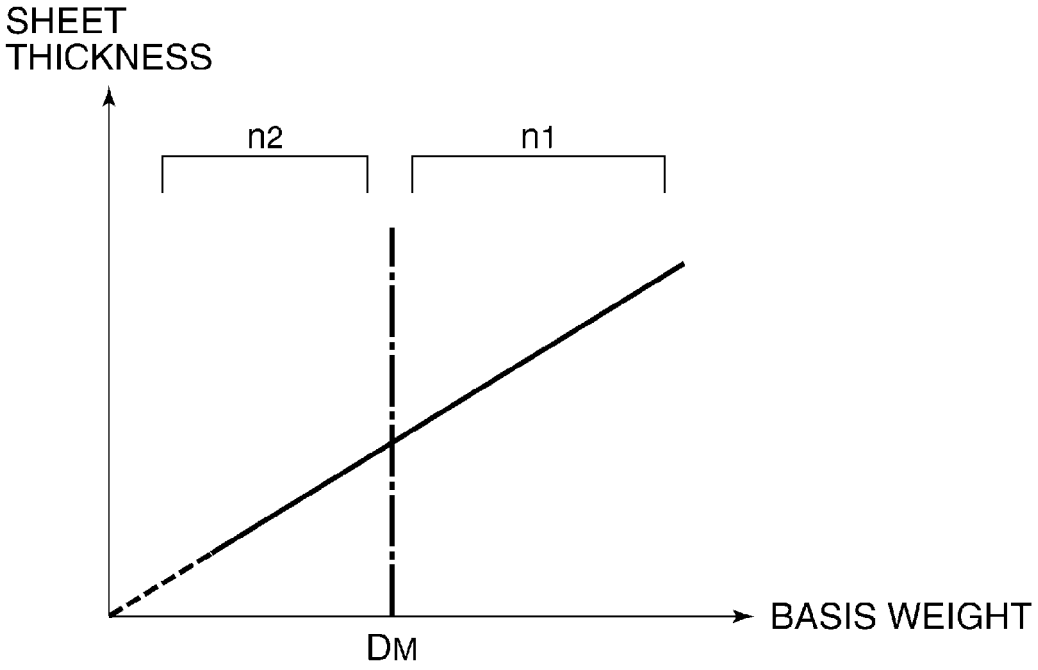
FIG. 6 is a graph showing a relation among sheet basis weight, sheet thickness, and degree of amplification in sheet thickness detection.

FIG. 6 is a graph of data showing a relation between sheet basis weight and sheet thickness. As shown in FIG. 6, sheet basis weight varies nearly in proportion to sheet thickness. In FIG. 6, symbols $n_1$, $n_2$ represent degrees of amplification in the detection of sheet thickness and respectively correspond to ratios $L_1/L$ and $L_2/L$ in formula (1) (see FIG. 4). As previously described, a saturation region where the sensor output characteristic is saturated becomes broad with the increase in degree of amplification (see, the sensor output characteristic denoted by symbol B in FIG. 5).

In this embodiment, the degree of amplification is set on a per sheet-thickness-range basis to avoid the sheet thickness detection from being performed in the saturation region. Specifically, the degree of amplification is made large in a relatively thin sheet thickness range and made small in a relatively thick sheet thickness range, so that the output characteristics of the magnetic sensors providing different degrees of amplification are utilized only at their parts with excellent linearity.

More specifically, in a case that sheets smaller in basis weight than a threshold value $D_M$ are set, the magnetic sensor 361*a* shown in FIG. 3 is selected, thereby setting the degree of amplification to a value of $n_2$, as shown in FIG. 6. On the other hand, in a case that sheets whose basis weight is larger than the threshold value $D_M$ are set, the magnetic sensor 362*a* shown in FIG. 3 is selected, thereby changing the degree of amplification to a value of n1, which is smaller than $n_2$. A relation between basis weight and sheet thickness is stored in advance in the ROM 701. When sheets to be used for a print job are confirmed, the CPU 411 recognizes whether the basis weight of the sheets to be used is smaller or larger than the threshold value $D_M$, and sets the degree of amplification according to a result of the recognition.

Next, a description will be given of a sheet feeding operation of the image forming system mounted with the sheet thickness detection devices 500, 501. In the following, a sheet feeding operation of the image forming apparatus 300, especially, a sheet thickness detection operation of the sheet thickness detection device 501 of the image forming apparatus 300, will be described. It should be noted that procedures of sheet thickness detection by the sheet thickness detection device 500 of the sheet feeding apparatus 301 are the same as those by the detection device 501 which will be described below.

Figure 7:
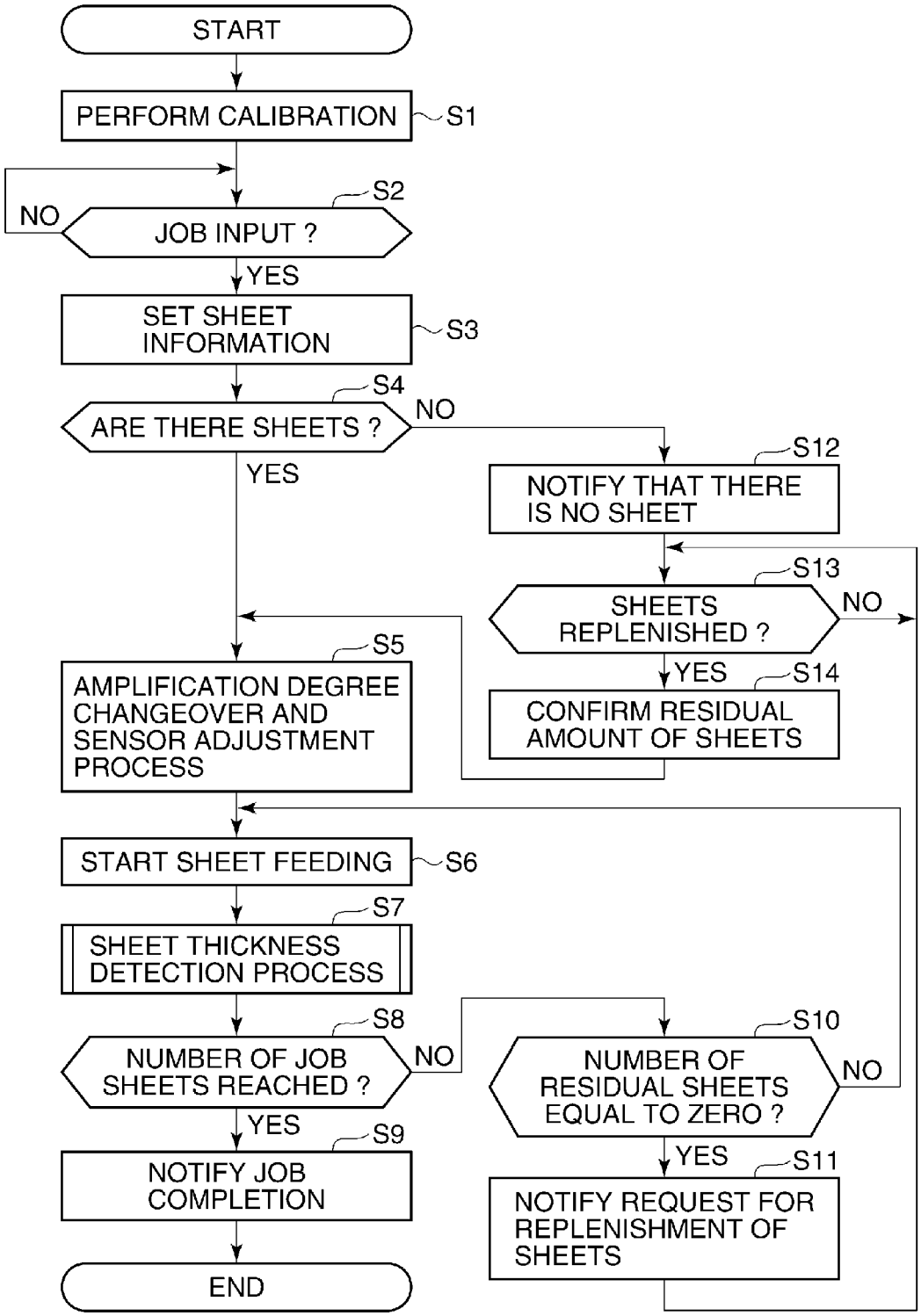
FIG. 7 is a flowchart showing the procedures of a sheet feed process performed by an image forming apparatus of the image forming system.
Figure 8:
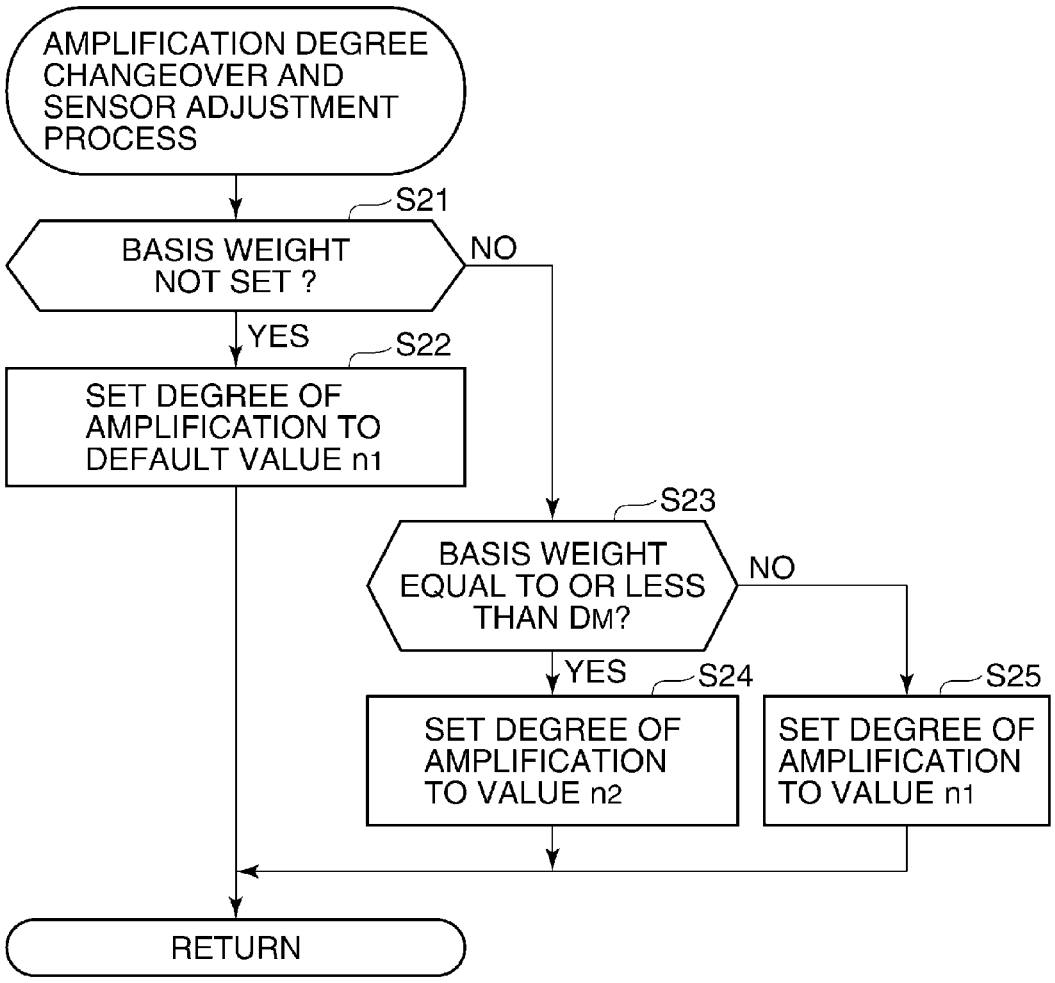
FIG. 8 is a flowchart showing the procedures of an amplification degree changeover and sensor adjustment process performed in the sheet feed process in FIG. 7.
Figure 9:
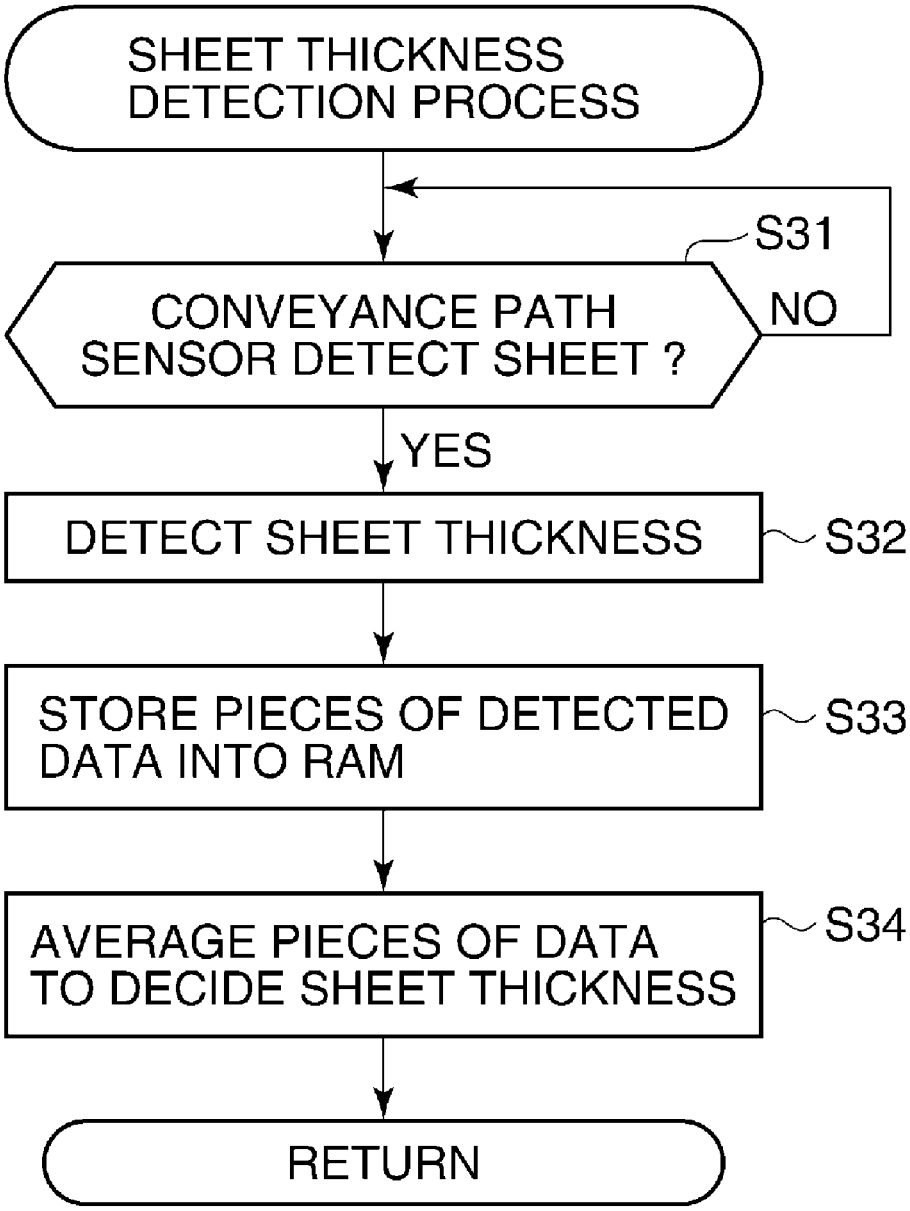
FIG. 9 is a flowchart showing the procedures of a sheet thickness detection process performed in the sheet feed process in FIG. 7.

FIG. 7 shows in flowchart the procedures of a sheet feed process performed by the image forming apparatus. FIG. 8 shows in flowchart the procedures of an amplification degree changeover and sensor adjustment operation process performed in the sheet feed process of FIG. 7, and FIG. 9 shows in flowchart the procedures of a sheet thickness detection process performed in the sheet feed process of FIG. 7.

The processes shown in the flowcharts are executed by the CPU 403 of the image forming apparatus 300. During an initialization of the entire image forming system at power-on, the CPU 403 calibrates the magnetic sensors 361*a*, 362*a* of the sheet thickness detection device 501 of the image forming apparatus 300 (step S1).

Figure 10:
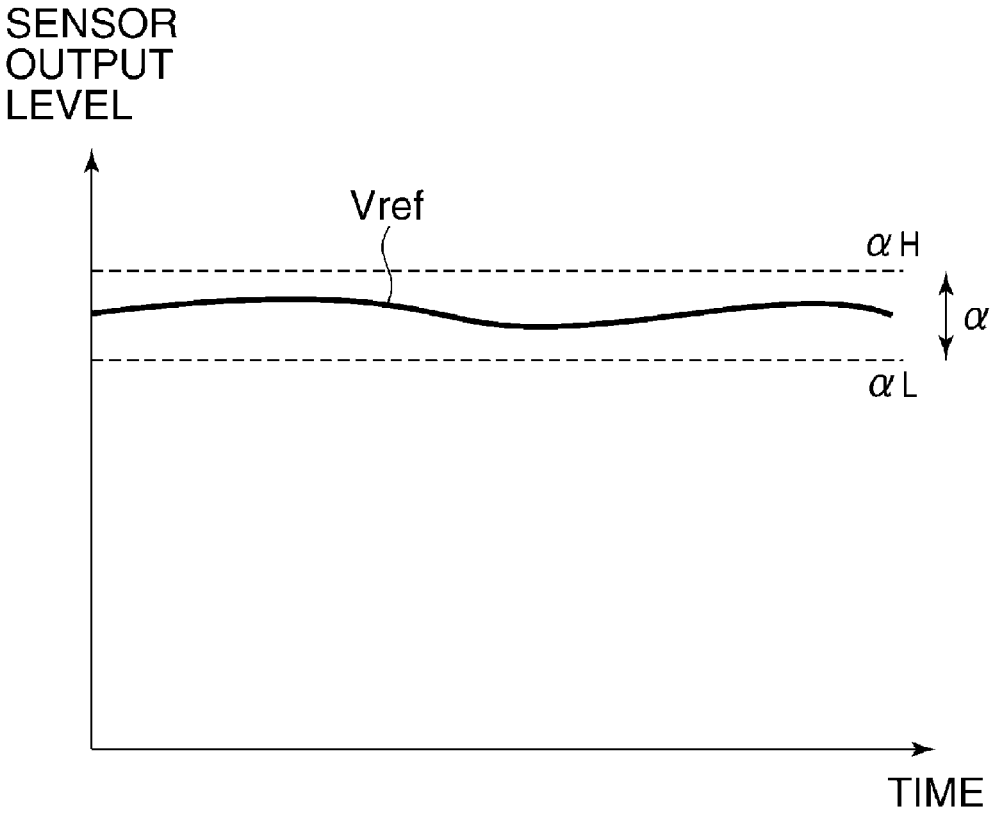
FIG. 10 is a graph showing a time-dependent change in output level of each magnetic sensor observed when the magnetic sensor is being calibrated.

The following is a description of the calibration of the magnetic sensors 361*a*, 362*a*. FIG. 10 is a graph showing a time-dependent change in output level of one of the magnetic sensors during the calibration thereof. An output voltage level $V_{ref}$ of the magnetic sensor in a sheet non-feed state and maximum and minimum allowable values $\alpha_H$, $\alpha_L$ of sensor output voltage level are stored in advance on a per sheet setting basis in the ROM 601 (in the ROM 701 for a case where sheets are fed from the sheet feeding apparatus 301). An allowable variation range $\alpha$ of output voltage level is decided by the maximum and minimum allowable values $\alpha_H$, $\alpha_L$. The CPU 403 determines whether the sensor output level $V_{ref}$ satisfies a relation of $\alpha_L<V_{ref}<\alpha_H$ based on an output level of the magnetic sensor 361*a* or 362*a* and the values $\alpha_H$, $\alpha_L$ decided according to the user's sheet setting. When determining that the sensor output level $V_{ref}$ does not converge within the allowable variation range $\alpha$, the CPU 403 performs an offset correction on the sensor output value to thereby adjust the sensor output level to become within the allowable range $\alpha$, whereupon the calibration of the magnetic sensor is completed.

After completion of the calibration of the magnetic sensors, the CPU 403 determines whether a print job is input (step S2). If a print job is input, the CPU 403 sets information of sheets used for the print job based on sheet information input through the operation unit 302 and notified to the CPU 403 through the bus 405 (step S3).

Next, the CPU 403 determines whether there are sheets in the sheet feed unit 313 (sheet feeder) (step S4). If there is no sheet, the CPU 403 notifies the user to that effect through, e.g., a display device (not shown) of the operation unit 302 (step S12), and waits for sheets being replenished by the user (step S13). When sheets are replenished, the CPU 403 confirms a residual amount of sheets in the sheet feeder (step S14), and proceeds to step S5.

If it is determined in step S4 that there are sheets in the sheet feeder or after the processing in step S14 is completed, the CPU 403 performs an amplification degree changeover and sensor adjustment process (step S5). As described later, in the amplification degree changeover and sensor adjustment process, which one of outputs of the magnetic sensors 361*a*, 362*a* should be input into the CPU 403 is decided based on the sheet information set in step S3.

Next, the CPU 403 starts sheet feeding from the sheet feed unit 313 (or from the sheet feeding apparatus 301) (step S6).

Next, the CPU 403 starts a sheet thickness detection process (step S7), and determines whether the number of output sheets desired by the user (predetermined number of job sheets) is reached (step S8). In a case that sheets are fed from the sheet feeding apparatus 301, whether the number of output sheets is reached can be determined by the CPU 411 of the sheet feeding apparatus 301 and notified to the CPU 403.

If the predetermined number of job sheets is reached, the CPU 403 completes the job, and notifies a job completion signal to the CPU 411 through the bus 405 (step S9), whereby the present process is completed and the image forming apparatus 300 waits for the next print job.

On the other hand, if it is determined in step S8 that the predetermined number of job sheets is not reached, the CPU 403 determines whether the number of residual sheets is equal to zero (step S10). If the number of residual sheets is not equal to zero, the flow returns to step S6. If the number of residual sheets is equal to zero, the CPU 403 notifies a request for replenishment of sheets (step S11), and proceeds to step S13.

In the following, with reference to FIG. 8, the amplification degree changeover and sensor adjustment process performed in step S5 in FIG. 7 will be described. As previously described, if it is determined in step S4 that there are sheets in the sheet feeder, or if the amount of residual sheets in the sheet feeder is confirmed in step S14, the sheet thickness detection device 501 starts the process of FIG. 8.

The CPU 403 first determines whether the basis weight of sheets used in the print job is set (step S21). If the basis weight of sheets is not set, the CPU 403 selects the magnetic sensor 362*a* and sets the degree of amplification in the sheet thickness detection device 501 to a default value $n_1$ (step S22).

On the other hand, if it is determined in step S21 that the basis weight of sheets is set, the CPU 403 determines whether the set basis weight of sheets is equal to or less than a threshold value $D_M$ (step S23). If it is determined that the set basis weight of sheets is equal to or less than the threshold value $D_M$, the CPU 403 selects the magnetic sensor 361*a* shown in FIG. 3 and sets the degree of amplification to a value of $n_2$ (step S24). If the set basis weight of sheets is larger than the threshold value $D_M$, the CPU 403 selects the magnetic sensor 362*a* shown in FIG. 3 and sets the degree of amplification to a value of $n_1$ (step S25), whereupon the flow returns to the sheet feed process shown in FIG. 7.

Referring to FIG. 9, a description will be given of the sheet thickness detection process, which is performed in step S7 in FIG. 7. As previously described, the process shown in FIG. 9 is started after the start of the sheet feed in step S6 in FIG. 7. The CPU 403 determines whether a sheet being conveyed has passed through the conveyance path sensor 380 (step S31). If the passage of a sheet is not detected, the flow returns to step S31.

In a case that the passage of a sheet is detected in step S31, the CPU 403 is triggered by a resultant detection signal and after lapse of a predetermined time period, starts sheet thickness detection (step S32). During a time period in which the sheet is passing through under the roller 366*a*, the CPU 403 samples a plurality of times sheet thickness data corresponding to the magnetic sensor output, and stores pieces of sampled data into the RAM 602 (step S33).

The CPU 403 averages the pieces of sheet thickness data stored in the RAM 602 in step S33 to thereby calculate and decide a sheet thickness (step S34), and returns to the sheet feed process of FIG. 7.

Figure 11:
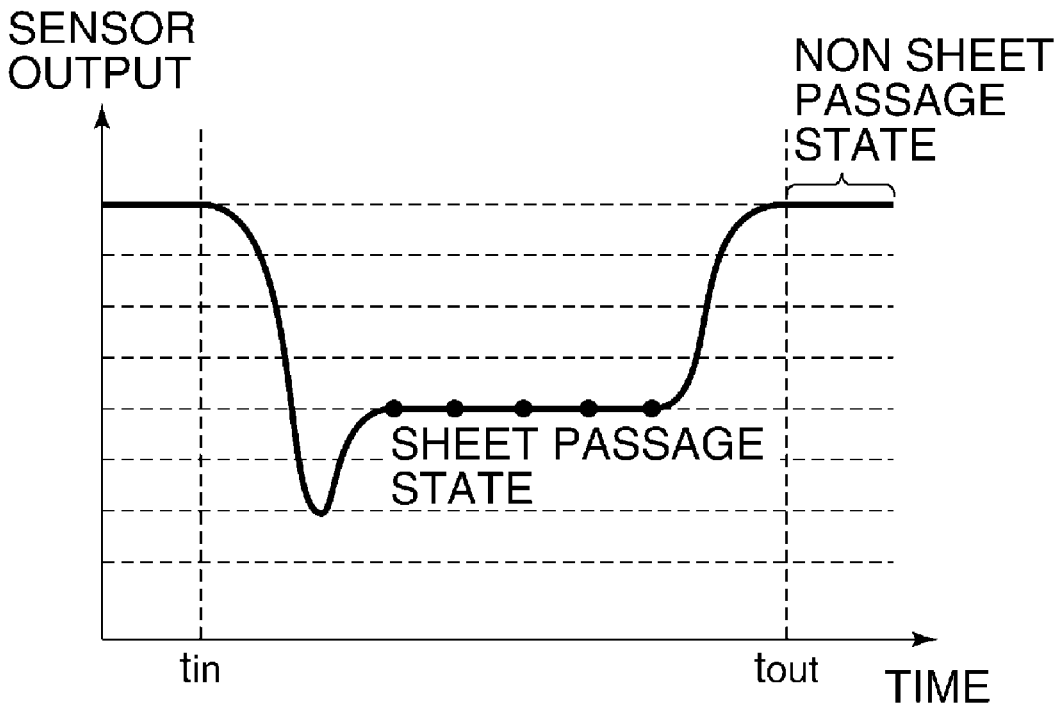
FIG. 11 is a graph showing a time-dependent change in output level of each magnetic sensor observed when sheet thickness data is being obtained from the sensor output.

Next, the way of how sheet thickness data is obtained from the detected sensor output will be described. FIG. 11 is a graph showing a time-dependent change in output level of each magnetic sensor observed when the sheet thickness data is being obtained from the sensor output.

When the sheet 368 enters under the roller 366*a*, an undershoot occurs in the sensor output, as shown in FIG. 11, due to impact shock. In this embodiment, the sensor output is masked for a time period where the undershoot occurs in the sensor output. In FIG. 11, symbol $t_{in}$ denotes a time when the leading end of the sheet 368 enters under the roller 366*a*, and symbol $t_{out}$ denotes a time when the trailing end of the sheet 368 escapes from under the roller 366*a*. The output signal of each of the magnetic sensors 361*a*, 362*a* is an analog signal and always output.

The CPU 403 starts acquisition of the sheet thickness data (i.e., the sensor output after A/D conversion) in a state where the sensor output signal level is stabilized. The CPU 403 acquires the sheet thickness data at a plurality of points (five points in the example shown in FIG. 11) and stores the acquired data into the RAM 602 (see step S33 in FIG. 9). Then, pieces of sheet thickness data obtained by removing the maximum and minimum values from the sheet thickness data acquired at the plurality of points are averaged to thereby decide a sheet thickness.

As described above, with the sheet thickness detection device of the first embodiment, the sheet thickness can be detected with accuracy since the amount of displacement of the detection part (i.e., the tip end of the driven member) caused by sheet passage is amplified through the driven member and one of a plurality of magnetic sensors is selected based on the sheet information, these sensors being different from one another in amplification degree by which the amount of displacement is amplified. Specifically, a magnetic sensor for amplifying the displacement amount of the detection part at a low amplification degree is selected for thick sheets, whereas a magnetic sensor for amplifying the displacement amount at a high amplification degree is selected for thin sheets. As a result, the amplification degree is changed according to sheet thickness such as to selectively utilize only those regions of output characteristics of the plurality of magnetic sensors where excellent linearity is obtainable, whereby the thickness of sheets from ultra-thin sheets such as 38 gram paper to thin sheets can be detected with accuracy. Furthermore, since the magnetic sensors are installed facing respective ones of magnets mounted to the driven member and each configured to detect a change in magnetic flux density around the corresponding magnet, the amplification degree at which the amount of displacement of the detection part is detected can variably be changed with ease by changing the mounting positions of the magnets and the installation positions of the magnetic sensors.

If the sheet feeder is replenished by the user with sheets different in type from that represented by sheet type information input by the user through the operation unit, sheets of a type different from the input one are fed, resulting in a fear that the temperature control for the fixing device according to sheet thickness will be inappropriate. In this regard, with the sheet thickness detection device of this embodiment, whether sheets being fed are different from sheets set by the user can be determined and, if there is inconsistency, a countermeasure such as discharging fed sheets to the escape tray 101 can be taken.

The first embodiment is configured to select a magnetic sensor based on sheet information. Alternatively, it is possible to roughly determine sheet type based on a signal output from any of the plurality of magnetic sensors that accurately represents sheet thickness and to select a magnetic sensor based on a result of the rough determination.

Second Embodiment

Next, a sheet thickness detection device according to a second embodiment of this invention will be described. Since an image forming system mounted with the sheet thickness detection device of the second embodiment is basically the same in construction as the system of the first embodiment, like parts will be denoted by like reference numerals, with a description thereof omitted.

Figure 18:
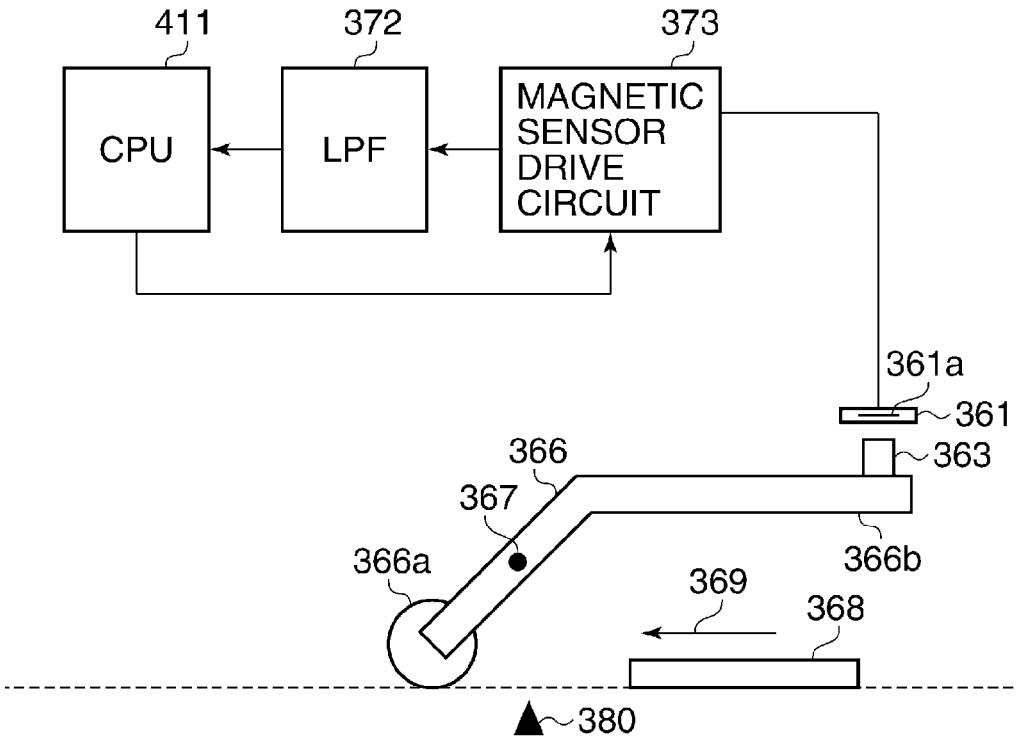
FIG. 18 is a schematic view showing the construction of a sheet thickness detection device according to a second embodiment of this invention.

The following is a description on sensitivity of the sheet thickness detection device. In this embodiment, as shown in FIG. 18, the sheet thickness detection device is only provided with the sheet thickness detection sensor board 361 among the sensor boards 361, 362 shown in FIG. 3. The magnetic sensor mounted on the sensor board 361 is driven by a constant current circuit, and the sensitivity of the magnetic sensor is controlled according to a value of electric current flowing through the magnetic sensor. The sensitivity of the magnetic sensor is represented by a sensor output voltage level per unit magnetic flux density.

For example, the magnetic sensor outputs an electric signal of 10 V when detecting a magnetic density of 100 mT. Such a magnetic sensor is higher in sensitivity than a magnetic sensor that outputs an electric signal of 1 V when detecting a magnetic density of 100 mT and is hence able to detect a minute change in gap distance between magnetic sensor and magnet (i.e., sheet thickness) with accuracy.

Figure 12:
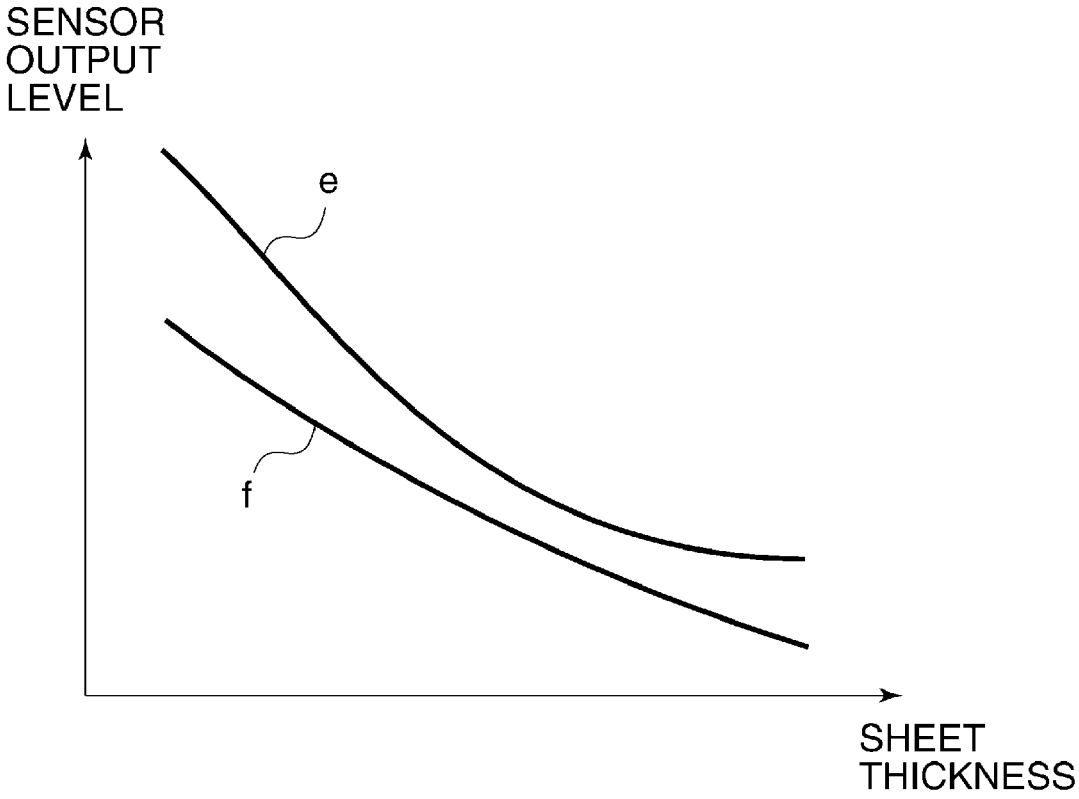
FIG. 12 is a graph showing a sheet thickness-to-output characteristic of the magnetic sensor.

FIG. 12 is a graph showing a sheet thickness-to-output characteristic of the magnetic sensor, where sheet thickness is taken along abscissa and sensor output voltage level is taken along ordinate.

As previously described, the gap distance between the magnetic sensor and the magnet becomes larger when a sheet passes through under the roller 366*a* of the driven member 366 than in a non sheet passage state, and the sensor output voltage level becomes lower for a thicker sheet. In FIG. 12, symbol e denotes a sensor characteristic having a high sensitivity (i.e., having a large value of electric current flowing through the magnetic sensor), and symbol f denotes a sensor characteristic having a low sensitivity.

Assuming that symbol $dv_e$ denotes a variation in output voltage of the sensor having the characteristic denoted by symbol e, symbol $dv_f$ denotes a variation in output voltage of the sensor having the characteristic denoted by symbol f, and symbol dt denotes a variation in sheet thickness, a variation ratio of sensor output relative to sheet thickness for a case where the sheet thickness is relatively thin is represented by the following formula (2).

$$|dv_e/dt| > |dv_f/dt| \quad (2)$$

To detect a minute displacement of the roller 366*a* (i.e., sheet thickness), it is preferable that the sensor output be made large. For example, a sensor that exhibits an output change of 200 mV when a sheet of 40 μm thickness passes through under the roller 366*a* is preferable than a sensor that exhibits an output change of 100 mV. In other words, the characteristic (sensitivity setting) denoted by symbol e in FIG. 12 is preferable than the sensitivity setting denoted by symbol f in that a larger change in sensor output can be attained upon passage of a sheet of the same thickness.

However, the high sensitivity characteristic denoted by symbol e is deteriorated in linearity with the increasing sheet thickness, so that the sensor output equivalent to sheet thickness cannot be obtained with high resolution in a region where sheet thickness is large. On the other hand, the linearity deterioration of the low sensitivity characteristic denoted by symbol f is small in the region where sheet thickness is large. In the large sheet thickness region, a sensor having the characteristic denoted by symbol f is able to detect the sheet thickness more accurately than a sensor having the characteristic denoted by symbol e.

Figure 13:
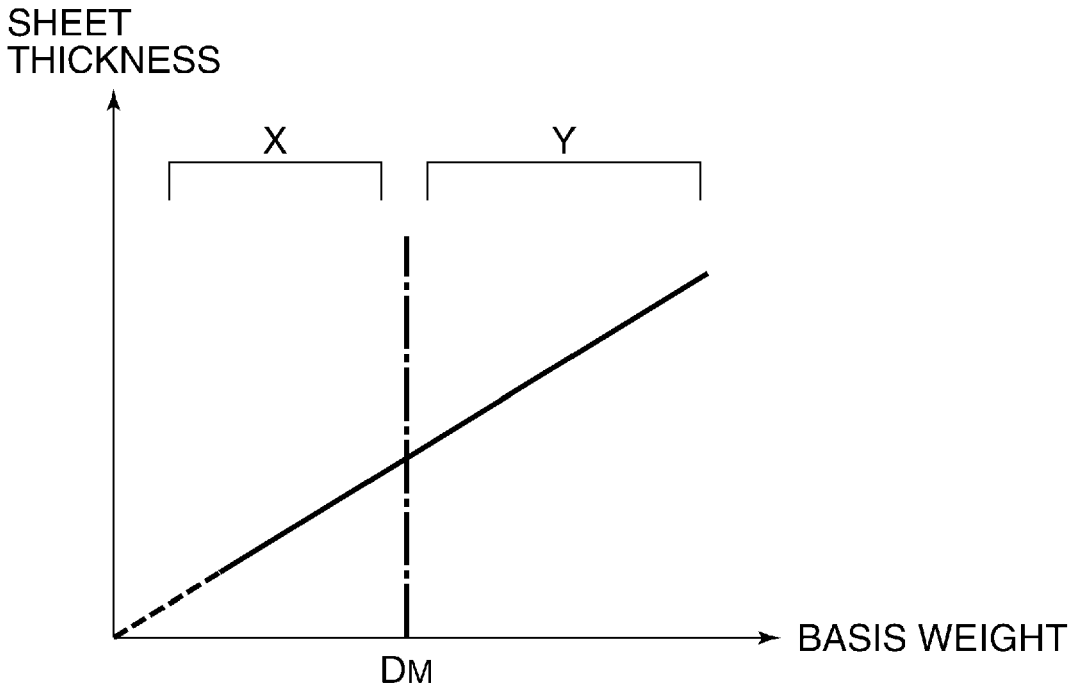
FIG. 13 is a graph showing a relation among sheet basis weight, sheet thickness, and sensor sensitivity.

FIG. 13 is a graph showing a relation between sheet basis weight and sheet thickness. As shown in FIG. 13, basis weight varies nearly in proportion to sheet thickness. In FIG. 13, symbol X denotes a sensor's sensitivity and symbol Y denotes a sensitivity lower than the sensitivity X. As previously described, to detect a relatively thin sheet thickness, the sensor's sensitivity is set to be higher than that used to detect a relatively thick sheet thickness.

More specifically, the sensitivity is set to a value of X for sheets having basis weight smaller than a threshold value $D_M$ and is changed to a value of Y for sheets of basis weight larger than the threshold value $D_M$, as shown in FIG. 13. In the ROM 601, the relation between basis weight and sheet thickness is stored in advance. When a print job is input, the CPU 403 recognizes whether the basis weight of sheets to be used is smaller or larger than the threshold value $D_M$, and sets the sensitivity according to a result of the recognition.

Figure 14:
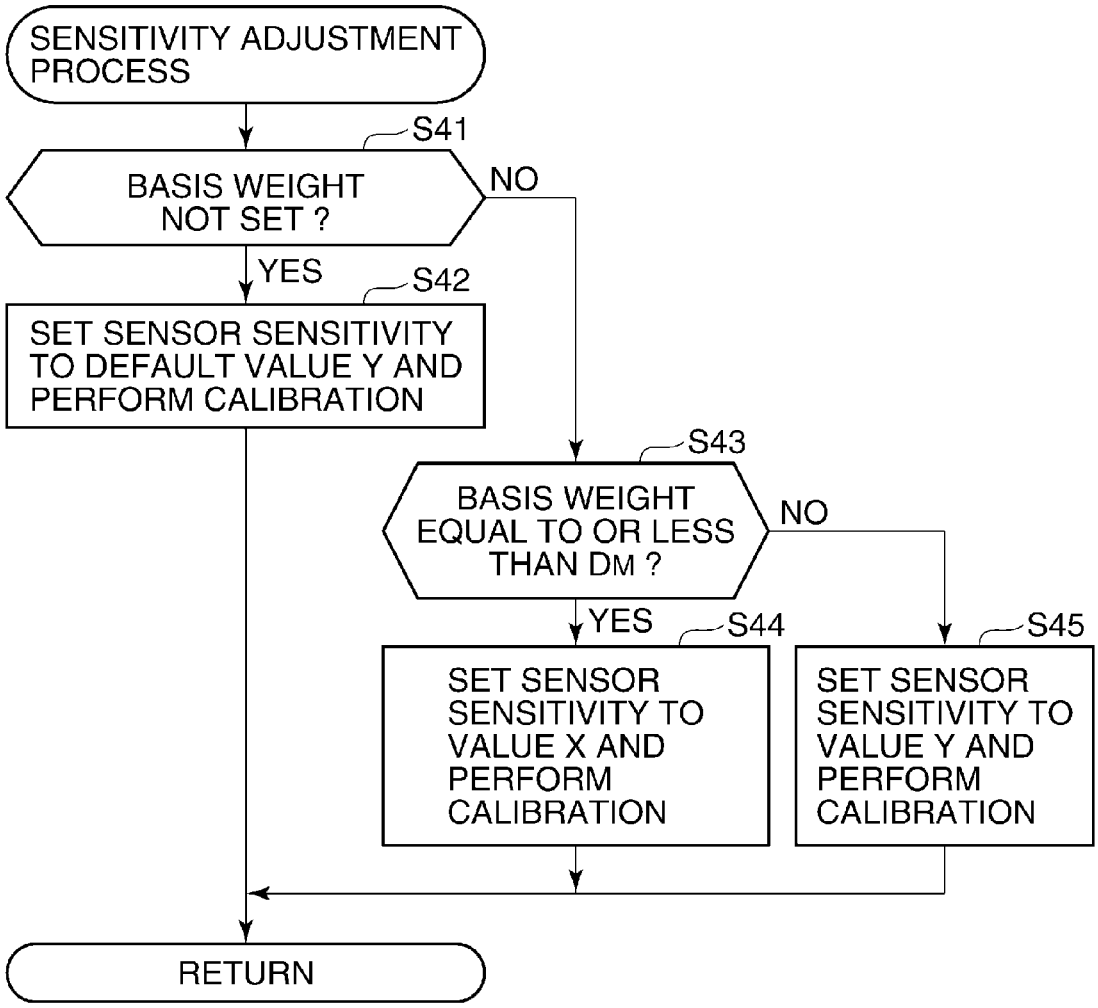
FIG. 14 is a flowchart showing the procedures of a sensor sensitivity adjustment process performed in the sheet feed process shown in FIG. 7.

Next, a description will be given of a sensor sensitivity adjustment process. FIG. 14 shows in flowchart the procedures of the sensor sensitivity adjustment process. Instead of the amplification degree changeover and sensor adjustment process previously described with reference to FIG. 8, the sensitivity adjustment process is executed in step S5 in the sheet feed process shown in FIG. 7.

The CPU 403 determines whether a basis weight is set for sheets specified in a print job (step S41). If a basis weight is not set, the CPU 403 sets the sensor sensitivity to a default value Y and calibrates the sensor output (step S42).

On the other hand, a basis weight is set, the CPU 403 determines whether the set sheet basis weight is equal to or less than the threshold value $D_M$ (step S43). If the sheet basis weight is equal to or less than the threshold value $D_M$, the CPU 403 sets the sensitivity to a value of X and then performs the calibration (step S44). On the other hand, if the sheet basis weight is larger than the threshold value $D_M$, the CPU 403 sets the sensor sensitivity to a value of Y less than X and performs the calibration (step S45). After the processing in step S42, S44, or S45 is completed, the flow returns to the sheet feed process shown in FIG. 7.

Figure 15:
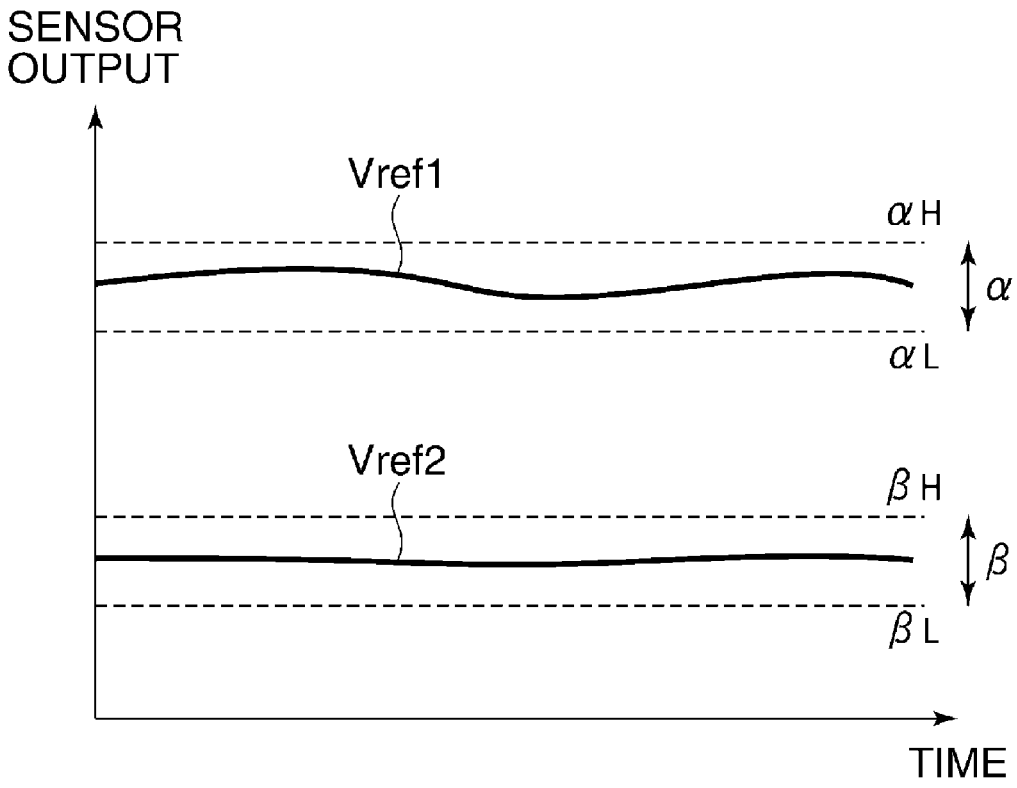
FIG. 15 is a graph showing a time-dependent change in output level of the magnetic sensor observed when the calibration is being performed.

The following is a description of the sensor calibration performed in steps S42, S44 and S45 in FIG. 14. FIG. 15 is a graph showing a time-dependent change in output level of the magnetic sensor during the calibration. The magnetic sensor always outputs an output signal.

In FIG. 15, symbol $V_{ref1}$ denotes an output voltage level in a non sheet passage state in a case that the sensor sensitivity is set to a value of X, and $V_{ref2}$ denotes an output voltage level in a non sheet passage state in a case that the sensor sensitivity is set to a value of Y. In the ROM 601, allowable maximum values $\alpha_H$, $\beta_H$ and allowable minimum values $\alpha_L$, $\beta_L$ by which allowable variation ranges α, β of output voltage level are decided are stored in advance.

The CPU 403 determines whether the sensor output level is within the allowable variation range.

Specifically, if the sensor sensitivity is set to a value of X in step S44 in FIG. 14, the CPU 403 determines whether the sensor output level $V_{ref1}$ satisfies the following formula (3).

$$\alpha_L < V_{ref1} < \alpha_H \quad (3)$$

When determining that the sensor output level $V_{ref1}$ does not satisfy formula (3), the CPU 403 performs an offset correction on the sensor output value so that the sensor output level $V_{ref1}$ falls within the allowable range α.

On the other hand, if the sensor sensitivity is set to a value of Y in step S42 or S45 in FIG. 14, the CPU 403 determines whether the sensor output level $V_{ref2}$ satisfies the following formula (4)

$$\beta_L < V_{ref2} < \beta_H \quad (4)$$

When determining that the sensor output level $V_{ref2}$ does not satisfy formula (4), the CPU 403 performs an offset correction on the sensor output value so that the sensor output level $V_{ref2}$ falls within the allowable range β.

As described above, with the sheet thickness detection device of the second embodiment, the sensitivity of the magnetic sensor (i.e., a value of electric current flowing through the magnetic sensor) is set to be large for relatively thin sheets and set to be small for relatively thick sheets. It should be noted that the degree of amplification through the driven member 366 is constant since the sheet thickness detection device of this embodiment is mounted with one magnetic sensor.

For thin sheets, the roller 366*a* is displaced by sheet passage by a small amount and therefore, the sensor sensitivity is raised, while maintaining the degree of amplification through the driven member 366 constant. For sheets other than thin sheets, the sensor sensitivity is lowered. As a result, it is possible to accurately detect the sheet thickness for sheets from ultra-thin sheets to thick sheets. Furthermore, the sensitivity of the magnetic sensor can easily be changed by changing a value of electric current supplied to the magnetic sensor.

The second embodiment is configured to change the sensitivity of one magnetic sensor. Alternatively, a plurality of magnetic sensors which are different in sensitivity from one another can be provided and a sheet thickness can be detected based on a result of detection by one of the magnetic sensors. In that case, the one magnetic sensor can be selected based on sheet information.

Third Embodiment

Since an image forming system according to a third embodiment is basically the same in construction as the systems of the first and second embodiments, like parts will be denoted by like reference numerals, with a description thereof omitted. The sheet thickness detection device of this embodiment has a mechanical construction provided with two magnetic sensors 361*a*, 362*a* shown in FIG. 3.

In the sheet thickness detection of the third embodiment, the degree of amplification and the sensitivity of magnetic sensor in the detection of amount of displacement of the roller 366*a* of the driven member 366 corresponding to the sheet thickness are set according to the basis weight of sheets.

Figure 16:
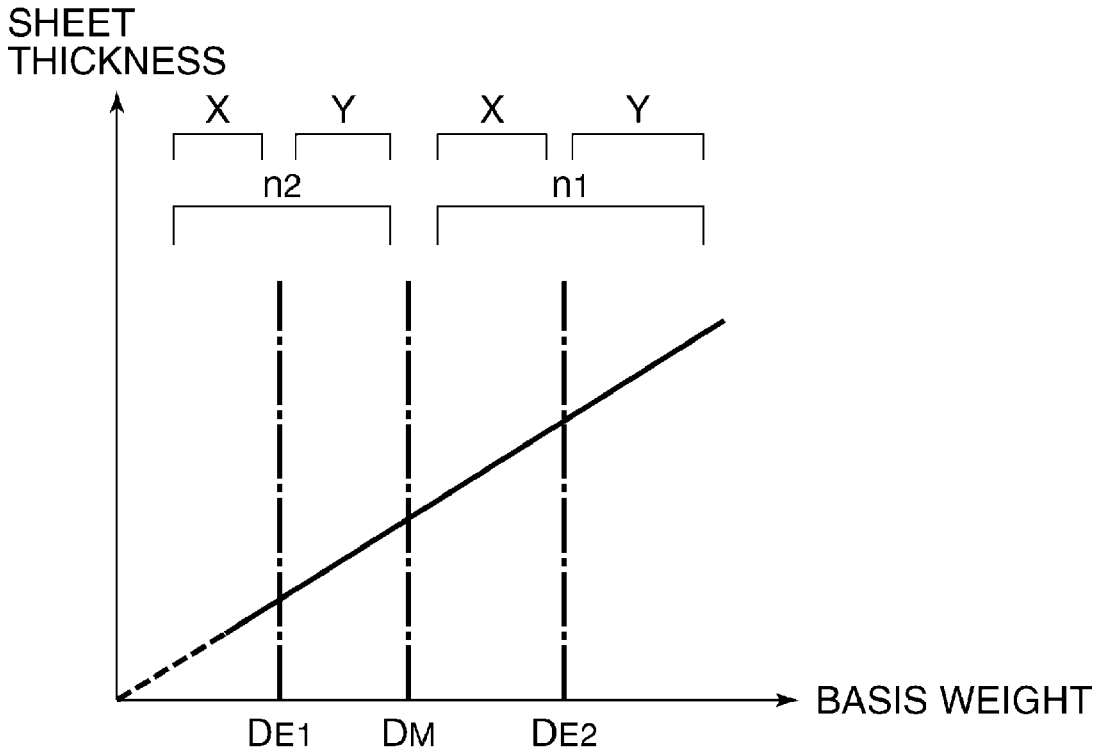
FIG. 16 is a graph showing a relation among sheet basis weight, sheet thickness, degree of amplification in sheet thickness detection, and sensor sensitivity in a third embodiment of this invention.

FIG. 16 is a graph showing a relation between sheet basis weight and sheet thickness in the third embodiment. As shown in FIG. 16, sheet basis weight varies nearly in proportion to sheet thickness. In FIG. 16, symbols $D_M$, $D_{E1}$, and $D_{E2}$ denote threshold values of basis weight, symbols $n_1$, $n_2$ denote degrees of amplification through the driven member 366, symbol X denotes a sensor sensitivity, and symbol Y denotes a sensor sensitivity lower than the sensitivity X.

In this embodiment, the magnetic sensor 361*a* is used and the amplification degree is set to a value of $n_2$ in a case where sheets whose basis weight is smaller than a threshold value $D_M$ are set, whereas the magnetic sensor 362*a* is used and the amplification degree is changed to a value of $n_1$ smaller than the value $n_2$ in a case where sheets whose basis weight is larger than the threshold value $D_M$ are set.

In the ROM 601, a relation between basis weight and sheet thickness is stored in advance. When sheets to be used for a print job are decided, the CPU 403 recognizes whether the basis weight of the sheets to be used is smaller or larger than the threshold value $D_M$, and sets the amplification degree according to a result of the recognition.

The CPU 403 sets the sensor sensitivity to the value X, if sheets are set, whose basis weight is smaller than the threshold value $D_{E1}$ which is smaller than the threshold value $D_M$, and sets the sensitivity to the value Y lower than the value X, if sheets are set, whose basis weight is smaller than the threshold value $D_M$ but larger than the threshold value $D_{E1}$.

The CPU 403 sets the sensor sensitivity to the value X, if sheets are set, whose basis weight is larger than the threshold value $D_{E2}$ which is larger than the threshold value $D_M$, and sets the sensitivity to the value Y, if sheets are set, whose basis weight is larger than the threshold value $D_{E2}$.

Figure 17:
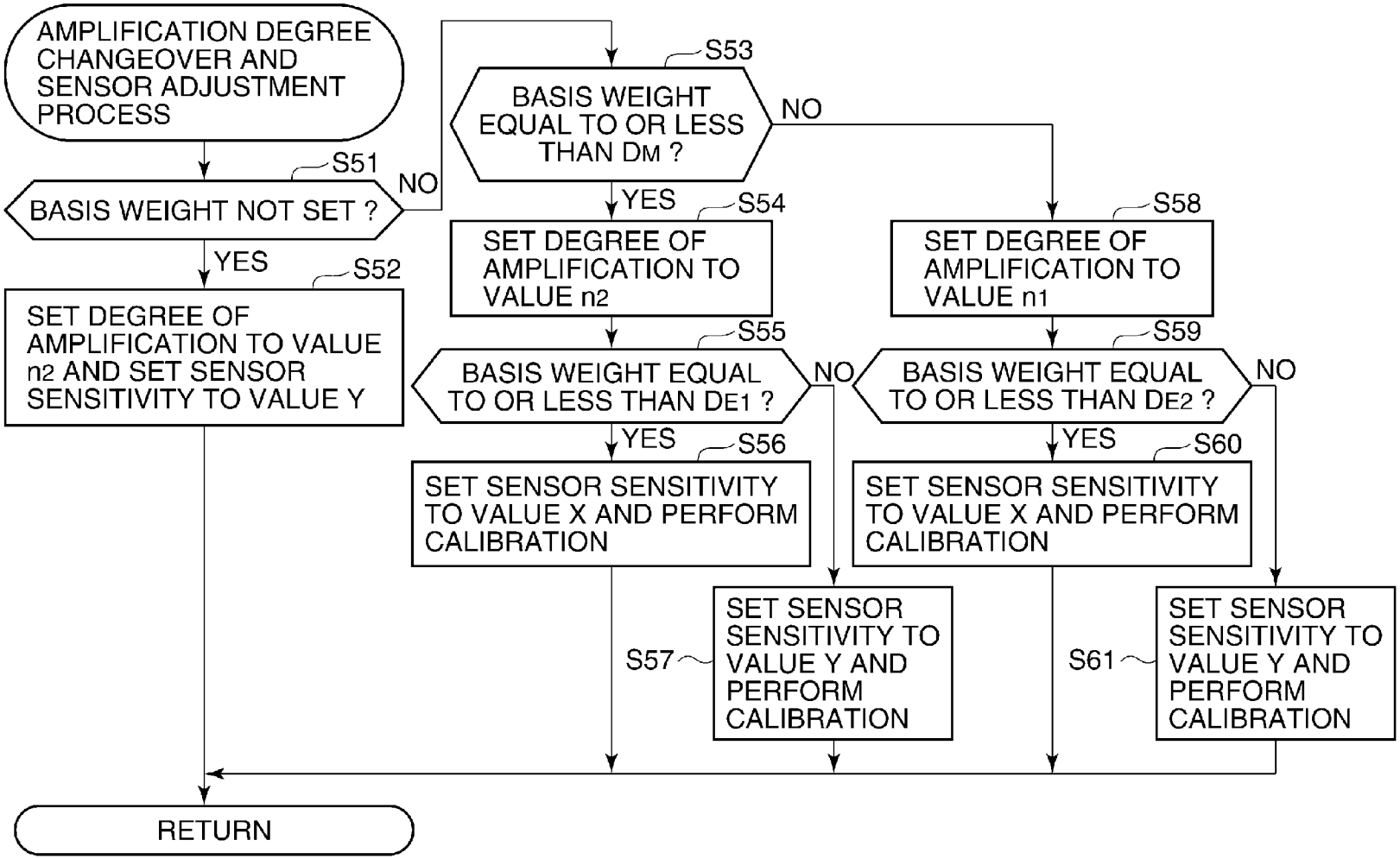
FIG. 17 is a flowchart showing the procedures of an amplification degree and sensor sensitivity adjustment process performed in the sheet feed process shown in FIG. 7.

The following is a description of an amplification degree and sensor sensitivity adjustment process. FIG. 17 shows in flowchart the procedures of the amplification degree and sensor sensitivity adjustment process. This adjustment process is executed in step S5 of the sheet feed process shown in FIG. 7 instead of the amplification degree changeover and sensor adjustment process previously described with reference to FIG. 8.

The CPU 403 determines whether a basis weight of sheets to be used for a print job is set (step S51). If a basis weight is set, the CPU 403 determines whether the set basis weight of sheets is equal to or less than the threshold value $D_M$ (step S53). If the basis weight is larger than the threshold value $D_M$, the CPU 403 sets the amplification degree to a value of $n_1$ (step S58). On the other hand, if the basis weight is equal to or less than the threshold value $D_M$, the CPU 403 sets the amplification degree to a value of $n_2$ (step S54).

Next, the CPU 403 determines whether the set basis weight of sheets is equal to or less than the threshold value $D_{E2}$ (step S55). If the basis weight is equal to or less than the threshold value $D_{E2}$, the CPU 403 sets the sensor sensitivity to a value of X and performs a calibration (step S56). On the other hand, the set basis weight of sheets is larger than the threshold value $D_{E2}$, the CPU 403 sets the sensor sensitivity to a value of Y and performs a calibration (step S57).

If it is determined in step S53 that the set basis weight of sheets is not equal to nor less than the threshold value $D_M$, the CPU 403 determines whether the sheet basis weight is equal to or less than the threshold value $D_{E2}$ (step S59). If the basis weight is equal to or less than the threshold value $D_{E2}$, the CPU 403 sets the sensor sensitivity to the value X and performs a calibration (step S60). On the other hand, if the basis weight is larger than the threshold value $D_{E2}$, the CPU 403 sets the sensor sensitivity to the value Y and performs a calibration (step S61).

If it is determined in step S51 that the basis weight of sheets to be used is not set, the CPU 403 sets the amplification degree to a default value $n_2$ and sets the sensor sensitivity to a default value Y, and performs a calibration (step S52). After the processing in any of steps S52, S56, S57, S60, and S61, the flow returns to the sheet feed process shown in FIG. 7. It should be noted that the sensitivity X can be set to different values between steps S56 and S60. Similarly, the sensitivity Y can be set to different values between steps S52, S57 and S61.

As described above, with the sheet thickness detection device of the third embodiment, even if it is difficult to detect the sheet thickness by only changing the amplification degree or by only changing the magnetic sensor sensitivity, the sheet thickness can accurately be detected by changing the amplification degree and the sensor sensitivity in an optimum combination. Specifically, it is possible to accurately detect the sheet thickness by increasing the amplification degree and the magnetic sensor sensitivity for ultra-thin sheets, but by decreasing the amplification degree and the magnetic sensor sensitivity for extremely thick sheets.

It should be noted that this invention is not limited in construction to the above described embodiments.

For example, the embodiments use, as a sheet thickness detection sensor, a magnetic sensor that cooperates with a magnet. Alternatively, there can be used an angle sensor that detects an amount of pivotal angle of an end portion of a swing member. Specifically, one or more angle sensors can be provided that detect an angle of displacement of a swing member while amplifying the angle two or three or more times.

In the embodiments, cases have been described where there is used as the driven member a swing member that is able to detect an amount of displacement of the roller provided at one end portion of the swing member (corresponding to sheet thickness) in the form of a pivot amount (swing amount) of another end portion thereof. Alternatively, a moving member configured to be movable in a sheet thickness direction and capable of detecting an amount of displacement of a roller mounted thereon can be used.

In the first and third embodiment, a plurality of magnetic sensors are used to detect an amount of displacement of the roller 366*a* at different degrees of amplification. Alternatively, there can be used one magnetic sensor configured to be movable according to the sheet basis weight. Specifically, it is possible to provide a mechanism for moving one magnetic sensor (e.g., the magnetic sensor 361*a*) and operate the mechanism to move the magnetic sensor 361*a* in a direction to increase the amplification degree by an amount that increases with the increasing sheet basis weight.

Although the sheet thickness detection device of the embodiments is configured to detect a thickness of a single sheet, the sheet thickness detection device can be used to detect a so-called multiple feeding where two or more sheets overlap one another and are conveyed together.

It is also possible to modify shapes and relative locations of component parts described in the embodiments according to the construction of an apparatus to which this invention is applied and according to conditions under which the apparatus operates.

This invention is not limited to an electrophotographic image forming apparatus that has been described by way of example in the embodiments, and is also applicable to printing methods such as an ink jet method, thermal transfer method, thermography method, electrostatic method, and discharge breakdown method.

Sheets are not limitative in shape and may be finite form sheet, tab sheet, or the like. Sheets are not limitative in material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042449, filed Feb. 26, 2010, is hereby incorporated by reference herein in its entirety.

What is claimed is:

1. A sheet thickness detection device for detecting a thickness of a sheet being conveyed, comprising:

a conveyance unit configured to convey a sheet along a conveyance path;

a displacement member configured to be displaced to follow a thickness of the sheet being conveyed, wherein said displacement member is comprised of a swing member pivotable about a fixed shaft, and one end portion of the swing member is pivoted to follow the thickness of the sheet;

a displacement amount detection unit configured to detect an amount of displacement of said displacement member at plural positions with different degrees of amplification by which the amount of displacement is amplified, wherein an amount of pivot of another end portion of the swing member is detected, as an amplified amount of displacement, by said displacement amount detection unit;

a sheet thickness detection unit configured to detect the thickness of the sheet based on a result of detection by said displacement amount detection unit in at least one of the plural positions;

an acquisition unit configured to acquire sheet information representing a sheet type; and a selection unit configured to select one of the plural positions based on the sheet information acquired by said acquisition unit, wherein said sheet thickness detection unit detects the thickness of the sheet based on a result of detection by said displacement amount detection unit in the position selected by said selection unit.

2. The sheet thickness detection device according to claim 1, said displacement amount detection unit includes a plurality of displacement amount detection sensors disposed at different positions.

3. The sheet thickness detection device according to claim 1, said displacement amount detection unit is configured to be movable.

4. The sheet thickness detection device according to claim 1, wherein said displacement amount detection unit includes a plurality of magnetic bodies mounted to the swing member at different positions and a plurality of magnetic sensors disposed facing respective ones of the magnetic bodies, and each magnetic flux density generated by the magnetic bodies is detected by each of the magnetic sensors corresponding to each of the magnetic bodies, whereby the amount of pivot of the other end portion of the swing member is detected as the amplified amount of displacement.

5. A sheet thickness detection device for detecting a thickness of a sheet being conveyed, comprising:

a conveyance unit configured to convey a sheet along a conveyance path;

a displacement member configured to be displaced to follow a thickness of the sheet being conveyed;

a displacement amount detection unit configured to detect an amount of displacement of said displacement member with a plurality of different sensitivities;

a sensitivity changeover unit configured to change a sensitivity of said displacement amount detection unit;

a sheet thickness detection unit configured to detect the thickness of the sheet based on a result of detection by said displacement amount detection unit with the sensitivity changed by said sensitivity changeover unit; and an electric current supply unit configured to supply an electric current to said displacement amount detection unit, wherein said sensitivity changeover unit changes the sensitivity of said displacement amount detection unit by changing a value of the electric current supplied from said electric current supply unit to said displacement amount detection unit.

6. The sheet thickness detection device according to claim 5, wherein said displacement member is comprised of a swing member pivotable about a fixed shaft, and one end portion of the swing member is pivoted to follow the thickness of the sheet and an amount of pivot of another end portion of the swing member is detected, as an amplified amount of displacement, by said displacement amount detection unit.

7. The sheet thickness detection device according to claim 6, wherein said displacement amount detection unit includes a magnetic body mounted to the swing member and a magnetic sensor disposed facing the magnetic body, and a magnetic flux density generated by the magnetic body is detected by the magnetic sensor, whereby the amount of pivot of the other end portion of the swing member is detected as the amplified amount of displacement.

8. The sheet thickness detection device according to claim 5, including:

an acquisition unit configured to acquire sheet information representing a sheet type, wherein said sensitivity changeover unit changes the sensitivity of said displacement amount detection unit based on the sheet information acquired by said acquisition unit.

9. A sheet thickness detection device for detecting a thickness of a sheet being conveyed, comprising:

a conveyance unit configured to convey a sheet along a conveyance path;

a displacement member configured to be displaced to follow a thickness of the sheet being conveyed, wherein said displacement member is comprised of a swing member pivotable about a fixed shaft, and one end portion of the swing member is pivoted to follow the thickness of the sheet;

a displacement amount detection unit configured to detect an amount of displacement of said displacement member at plural positions with different degrees of amplification by which the amount of displacement is amplified, wherein an amount of pivot of another end portion of the swing member is detected, as an amplified amount of displacement, by said displacement amount detection unit;

a sensitivity changeover unit configured to change a sensitivity of said displacement amount detection unit;

a sheet thickness detection unit configured to detect the thickness of the sheet based on a result of detection by said displacement amount detection unit in the at least one of the plural positions with the sensitivity changed by said sensitivity changeover unit; and an electric current supply unit configured to supply an electric current to said displacement amount detection unit, wherein said sensitivity changeover unit changes the sensitivity of said displacement amount detection unit by changing a value of the electric current supplied from said electric current supply unit to said displacement amount detection unit.

10. The sheet thickness detection device according to claim 9, wherein said displacement amount detection unit includes a plurality of magnetic bodies mounted to the swing member at different positions and a plurality of magnetic sensors disposed facing respective ones of the magnetic bodies, and each magnetic flux density generated by the magnetic bodies is detected by each of the magnetic sensors corresponding to each of the magnetic bodies, whereby the amount of pivot of the other end portion of the swing member is detected as the amplified amount of displacement.

11. The sheet thickness detection device according to claim 9, including:

an acquisition unit configured to acquire sheet information representing a sheet type; and a selection unit configured to select one of the plural positions based on the sheet information acquired by said acquisition unit, wherein said sensitivity changeover unit changes the sensitivity of said displacement amount detection unit based on the sheet information acquired by said acquisition unit, and said sheet thickness detection unit detects the thickness of the sheet based on a result of detection by said displacement amount detection unit in the position selected by said selection unit.

12. An image forming apparatus mounted with a sheet thickness detection device for detecting a thickness of a sheet being conveyed, and configured to form an image on the sheet being conveyed, the sheet thickness detection device comprising:

a conveyance unit configured to convey a sheet along a conveyance path;

a displacement member configured to be displaced to follow a thickness of the sheet being conveyed, wherein said displacement member is comprised of a swing member pivotable about a fixed shaft, and one end portion of the swing member is pivoted to follow the thickness of the sheet;

a displacement amount detection unit configured to detect an amount of displacement of said displacement member at plural positions with different degrees of amplification by which the amount of displacement is amplified, wherein an amount of pivot of another end portion of the swing member is detected, as an amplified amount of displacement, by said displacement amount detection unit;

a sheet thickness detection unit configured to detect the thickness of the sheet based on a result of detection by said displacement amount detection unit in at least one of the plural positions;

an acquisition unit configured to acquire sheet information representing a sheet type; and a selection unit configured to select one of the plural positions based on the sheet information acquired by said acquisition unit, wherein said sheet thickness detection unit detects the thickness of the sheet based on a result of detection by said displacement amount detection unit in the position selected by said selection unit.

13. An image forming apparatus mounted with a sheet thickness detection device for detecting a thickness of a sheet being conveyed, and configured to form an image on the sheet being conveyed, the sheet thickness detection device comprising:

a conveyance unit configured to convey a sheet along a conveyance path;

a displacement member configured to be displaced to follow a thickness of the sheet being conveyed;

a displacement amount detection unit configured to detect an amount of displacement of said displacement member with a plurality of different sensitivities;

a sensitivity changeover unit configured to change a sensitivity of said displacement amount detection unit;

a sheet thickness detection unit configured to detect the thickness of the sheet based on a result of detection by said displacement amount detection unit with the sensitivity changed by said sensitivity changeover unit; and an electric current supply unit configured to supply an electric current to said displacement amount detection unit, wherein said sensitivity changeover unit changes the sensitivity of said displacement amount detection unit by changing a value of the electric current supplied from said electric current supply unit to said displacement amount detection unit.

14. An image forming apparatus mounted with a sheet thickness detection device for detecting a thickness of a sheet being conveyed, and configured to form an image on the sheet being conveyed, the sheet thickness detection device comprising:

a conveyance unit configured to convey a sheet along a conveyance path;

a displacement member configured to be displaced to follow a thickness of the sheet being conveyed, wherein said displacement member is comprised of a swing member pivotable about a fixed shaft, and one end portion of the swing member is pivoted to follow the thickness of the sheet;

a displacement amount detection unit configured to detect an amount of displacement of said displacement member at plural positions with different degrees of amplification by which the amount of displacement is amplified, wherein an amount of pivot of another end portion of the swing member is detected, as an amplified amount of displacement, by said displacement amount detection unit;

a sensitivity changeover unit configured to change a sensitivity of said displacement amount detection unit;

a sheet thickness detection unit configured to detect the thickness of the sheet based on a result of detection by said displacement amount detection unit in the at least one of the plural positions with the sensitivity changed by said sensitivity changeover unit; and an electric current supply unit configured to supply an electric current to said displacement amount detection unit, wherein said sensitivity changeover unit changes the sensitivity of said displacement amount detection unit by changing a value of the electric current supplied from said electric current supply unit to said displacement amount detection unit.

* * * * *